US005933128A

United States Patent [19]

Kuribayashi et al.

[11] Patent Number: 5,933,128

[45] Date of Patent: Aug. 3, 1999

[54] CHIRAL SMECTIC LIQUID CRYSTAL APPARATUS AND DRIVING METHOD THEREFOR

[75] Inventors: Masaki Kuribayashi, Inagi; Osamu Ikeda, Tokyo; Kazunori Katakura, Atsugi; Hironao Kimura, Kawasaki; Hidetoshi Tsuzuki, Yokohama, all of Japan

[73] Assignee: Canon Kabushiki Kaisha, Tokyo, Japan

[21] Appl. No.: 08/648,996

[22] Filed: May 17, 1996

[30] Foreign Application Priority Data

| | | | |
|---|---|---|---|
| May 17, 1995 | [JP] | Japan | 7-118496 |
| May 17, 1995 | [JP] | Japan | 7-118497 |
| May 19, 1995 | [JP] | Japan | 7-121470 |
| May 19, 1995 | [JP] | Japan | 7-121471 |

[51] Int. Cl.[6] ..... G09G 3/36

[52] U.S. Cl. ..... 345/95; 345/97; 349/133; 349/136

[58] Field of Search ..... 345/87–97; 349/133, 349/136

[56] References Cited

U.S. PATENT DOCUMENTS

| | | | |
|---|---|---|---|
| 4,622,721 | 11/1986 | Smetz et al. | 25/68 CD |
| 4,639,089 | 1/1987 | Okada et al. | 350/341 |
| 4,763,995 | 8/1988 | Katagiri et al. | 350/341 |
| 4,776,676 | 10/1988 | Inoue et al. | 350/350 S |
| 4,900,132 | 2/1990 | Bos | 350/346 |
| 4,997,264 | 3/1991 | Coulson | 350/350 S |
| 5,046,823 | 9/1991 | Mori et al. | 359/56 |
| 5,136,408 | 8/1992 | Okada et al. | 345/97 |
| 5,262,082 | 11/1993 | Janulis et al. | 345/97 |
| 5,267,065 | 11/1993 | Taniguchi et al. | 345/97 |
| 5,283,564 | 2/1994 | Katakura et al. | 345/87 |
| 5,321,419 | 6/1994 | Katakura et al. | 345/97 |
| 5,353,041 | 10/1994 | Miyamoto et al. | 345/97 |
| 5,377,033 | 12/1994 | Radcliffe | 359/75 |
| 5,469,281 | 11/1995 | Katakura et al. | 359/56 |
| 5,471,229 | 11/1995 | Okada et al. | 345/89 |
| 5,489,919 | 2/1996 | Kuwata et al. | 345/100 |
| 5,519,411 | 5/1996 | Okada et al. | 345/89 |
| 5,521,727 | 5/1996 | Inaba et al. | 359/56 |
| 5,532,713 | 7/1996 | Okada et al. | 345/97 |
| 5,583,534 | 12/1996 | Katakura et al. | 345/97 |
| 5,594,571 | 1/1997 | Hanyu et al. | 349/138 |
| 5,602,562 | 2/1997 | Onitsuka et al. | 345/97 |
| 5,606,343 | 2/1997 | Tsuboyama et al. | 345/97 |

FOREIGN PATENT DOCUMENTS

| | | |
|---|---|---|
| A20450459 | 10/1991 | European Pat. Off. . |
| A10637622 | 8/1995 | European Pat. Off. . |
| 62-28717 | 2/1987 | Japan . |
| 62-260125 | 11/1987 | Japan . |
| 6-95624 | 4/1994 | Japan . |
| 6-202078 | 7/1994 | Japan . |
| 6-202082 | 7/1994 | Japan . |

OTHER PUBLICATIONS

Ito, Keizo, "Switching Among Three Stable States of Anti–Ferroelectric Stabilized (AFS) Ferroelectric Liquid Crystal (FLC)", Television Society (in Japanese), vol. 44, No. 5, pp. 536–543 (1990).

*Primary Examiner*—Jeffery Brier
*Assistant Examiner*—David L Lewis
*Attorney, Agent, or Firm*—Fitzpatrick, Cella, Harper & Scinto

[57] ABSTRACT

A liquid crystal apparatus includes (a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means for: sequentially applying a scanning selection signal to the scanning electrodes to select at least one scanning electrode, and applying a data signal having at least three peak values to the data electrodes in synchronism with the scanning selection signal. A DC bias voltage may be applied between the scanning electrodes and the data electrodes, and the polarity of the DC voltage may be switched for each prescribed period. The above system is suitable for obviating or suppressing the "sticking" phenomenon of a chiral smectic liquid crystal.

84 Claims, 24 Drawing Sheets

SCAN LINE
SELECTION PERIOD
1/2ΔT
1/2ΔT
3/2ΔT
ΔT
2Vo
0
-2Vo

SCAN
SELECTION
SIGNAL (Ss)

SCAN
NON-SELECTION
SIGNAL (SN)
0
Vo
0
-1/2Vo
-3/2Vo

DATA
SIGNAL 1(Is)
3/2Vo
1/2Vo
0
-Vo

DATA
SIGNAL 2(IN)

1/2ΔT
1/2ΔT
3/2ΔT
ΔT
2Vo
0
-2Vo

SCAN SELECTION SIGNAL (Ss)
0

SCAN NON-SELECTION SIGNAL (SN)
Vo
0
-1/2Vo
-3/2Vo

DATA SIGNAL 1(Is)
3/2Vo
1/2Vo
0
-Vo

DATA SIGNAL 2(IN)

SCAN LINE
SELECTION PERIOD
1/2ΔT
1/2ΔT
3ΔT
ΔT
2Vo
0
-2Vo

SCAN
SELECTION
SIGNAL (Ss)

SCAN
NON-SELECTION
SIGNAL (SN)
0
Vo
0
-1/2Vo
-3/2Vo

DATA
SIGNAL 1(Is)
3/2Vo
1/2Vo
0
-Vo

DATA
SIGNAL 2(IN)

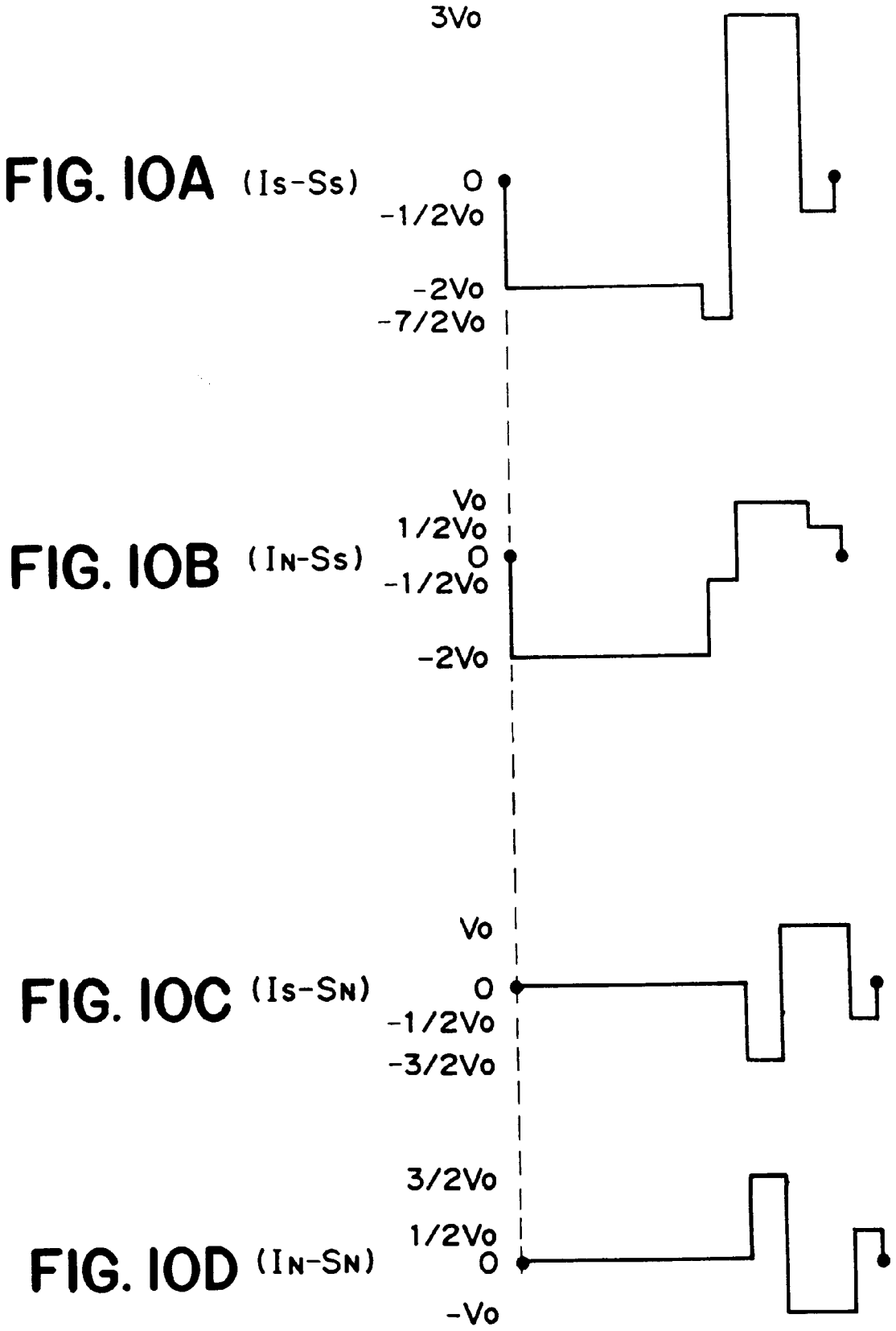
FIG. 10A (Is-Ss)
3Vo
0
-1/2Vo
-2Vo
-7/2Vo
FIG. 10B (IN-Ss)
Vo
1/2Vo
0
-1/2Vo
-2Vo
FIG. 10C (Is-SN)
Vo
0
-1/2Vo
-3/2Vo
FIG. 10D (IN-SN)
3/2Vo
1/2Vo
0
-Vo

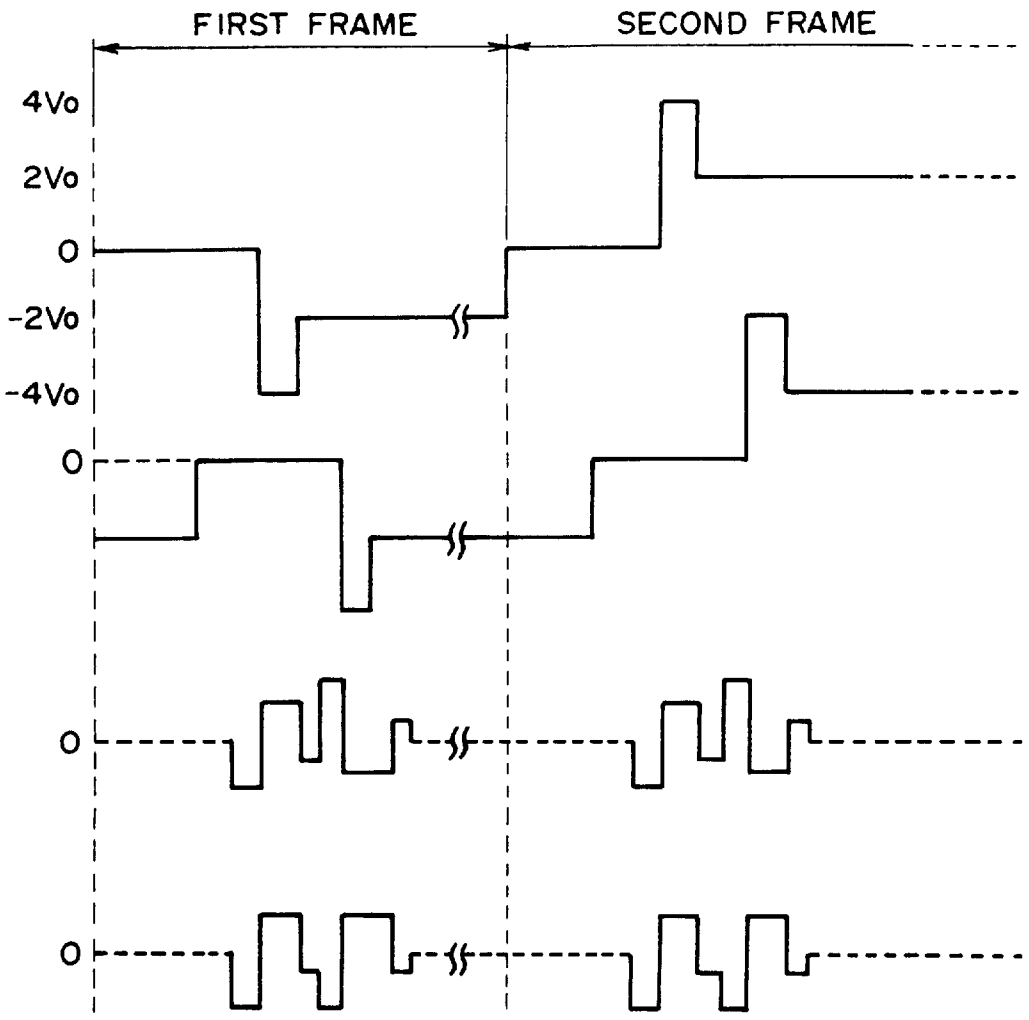
FIG. 13A $S_1$
FIG. 13B $S_2$
FIG. 13C $I_1$
FIG. 13D $I_2$

1/2ΔT
1/2ΔT
3/2ΔT
ΔT
2Vo
0
-2Vo

SCAN SELECTION SIGNAL (Ss)

SCAN NON-SELECTION SIGNAL (SN)
0
Vo
0
-1/2Vo
-3/2Vo
(-Vo)

DATA SIGNAL 1 (Is)
3/2Vo
1/2Vo
0
-Vo
(Vo)

DATA SIGNAL 2 (IN)

1/2ΔT
1/2ΔT
3/2ΔT
ΔT
2Vo
0
-2Vo
SCAN SELECTION SIGNAL (Ss)

SCAN NON-SELECTION SIGNAL (SN)

0
Vo
0
-1/2Vo
-3/2Vo
(-Vo)
DATA SIGNAL 1 (Is)

3/2Vo
1/2Vo
0
-Vo
(Vo)
DATA SIGNAL 2 (IN)

FIRST PERIOD
SECOND PERIOD
1/2ΔT
1/2ΔT
2ΔT
ΔT

SCAN SELECTION SIGNAL (Ss)
2Vo
0
-2Vo

SCAN NON-SELECTION SIGNAL (SN)
VDC
0
-VDC

DATA SIGNAL 1(Is)
Vo
0
-Vo

DATA SIGNAL 2(IN)
Vo
0
-Vo

FIRST PERIOD
SECOND PERIOD
1/2ΔT
1/2ΔT
2ΔT
ΔT

SCAN SELECTION SIGNAL (Ss)
2Vo
0
-2Vo

SCAN NON-SELECTION SIGNAL (SN)

DATA SIGNAL 1 (Is)
Vo+VDC
VDC
-Vo+VDC
Vo-VDC
-VDC
-Vo-VDC

DATA SIGNAL 2 (IN)

FIRST PERIOD
SECOND PERIOD (Is-Is)
3Vo
0
-Vo
-2Vo
-3Vo (IN-Ss)
Vo
0
-Vo
-2Vo (Is-SN)
Vo+VDC
VDC
-Vo+VDC
0
Vo-VDC
-VDC
-Vo-VDC (IN-SN)
Vo+VDC
VDC
-Vo+VDC
0
Vo-VDC
-VDC
-Vo-VDC

FIRST PERIOD
SECOND PERIOD
1/2ΔT
1/2ΔT
2ΔT
ΔT

SCAN SELECTION SIGNAL (Ss)
2Vo
Vo
0
-2Vo

SCAN NON-SELECTION SIGNAL (SN)
VDC
0
-VDC

DATA SIGNAL 1(Is)
Vo
0
-Vo

DATA SIGNAL 2(IN)
Vo
0
-Vo

FIRST PERIOD
SECOND PERIOD
1/2ΔT
1/2ΔT
2ΔT
ΔT

SCAN SELECTION SIGNAL (Ss)
2Vo
Vo
0
-2Vo

SCAN NON-SELECTION SIGNAL (SN)

DATA SIGNAL 2 (IN)
Vo+VDC
VDC
-Vo+VDC
Vo-VDC
-VDC
-Vo-VDC

DATA SIGNAL 1 (Is)

FIRST PERIOD
SECOND PERIOD (Is-Is)
3Vo
0
-Vo
-2Vo
-3Vo (IN-Ss)
Vo
0
-Vo
-2Vo (Is-SN)
Vo+VDC
VDC
-Vo+VDC
0
Vo-VDC
-VDC
-Vo-VDC (IN-SN)

CHIRAL SMECTIC LIQUID CRYSTAL APPARATUS AND DRIVING METHOD THEREFOR

FIELD OF THE INVENTION AND RELATED ART

The present invention relates to a liquid crystal apparatus including a liquid crystal panel using a chiral smectic liquid crystal exhibiting a ferroelectric state or both a ferroelectric state and an anti-ferroelectric state, and a matrix drive means therefor.

A liquid crystal device using a chiral smectic liquid crystal in a chevron structure as disclosed in U.S. Pat. Nos. 4,900,132 or 4,997,264 has required a high-luminance light source in order to provide a display of a sufficient brightness because it is difficult to set a large tilt angle. U.S. Pat. No. 5,377,033, etc., have disclosed a device using a chiral smectic liquid crystal in a bookshelf structure capable of exhibiting a large tilt angle. The chiral smectic liquid crystal exhibiting a bookshelf structure does not exhibit cholesteric phase in the course of cooling from the isotropic phase but develops smectic A phase directly from the isotropic phase, so that it has been difficult to obtain a uniform alignment state by using the alignment control method for developing the alignment state in the chevron structure. EP-A 637622 has disclosed a chiral smectic liquid crystal panel realizing a bookshelf structure in a uniform alignment state by using a pair of substrates including one subjected to a uniaxial aligning treatment such as rubbing or oblique vapor deposition and the other substrate subjected to a random aligning treatment not providing a uniaxial alignment characteristic.

Further, it also has been reported that a uniform alignment of a chiral smectic liquid crystal exhibiting an anti-ferroelectric state and directly assuming smectic A phase from isotropic phase can be realized by applying a polyimide rubbing alignment technique to only one of a pair of substrates (Keizo ITO; "Switching among Three Stable States of Anti-Ferroelectric Stabilized (AFS) Ferroelectric Liquid Crystal (FLC)", Television Society (in Japanese), Vol. 44, No. 5, pp. 536–543 (1990)). The paper has also reported that a chevron structure is developed under no electric field and a bookshelf structure is developed under voltage application.

It has been found that such a liquid crystal panel using a chiral smectic liquid crystal allowing a high-brightness display is accompanied with a so-called "sticking" phenomenon that, during a display operation according to a matrix drive scheme, the alignment state of the chiral smectic liquid crystal is changed with time so that only one alignment state among a plurality of expected stable alignment states becomes a stable alignment state, because of factors such that an asymmetrical alignment control structure is provided to a pair of substrates and the chiral smectic liquid crystal used has a spontaneous polarization of 10 $nC/cm^2$ or higher.

SUMMARY OF THE INVENTION

A principal object of the present invention is to provide a liquid crystal apparatus capable of alleviating or suppressing the above-mentioned "sticking" phenomenon.

According to the present invention, there is provided a liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means for:

sequentially applying a scanning selection signal to the scanning electrodes to select at least one scanning electrode, and applying a data signal having at least three peak values to the data electrodes in synchronism with the scanning selection signal.

According to another aspect of the present invention, there is provided a liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means for:

sequentially applying a scanning selection signal to the scanning electrodes to select at least one scanning electrode, said scanning selection signal comprising voltages of at least a first phase and a second phase having mutually different peak values, and applying a data signal having at least three peak values to the data electrodes in synchronism with the scanning selection signal, so that in the first phase, the pixels on the selected scanning electrode are supplied with a voltage exceeding one threshold of the chiral smectic liquid crystal to be non-selectively reset to a cleared state and, in the second phase, a selected pixel among the cleared pixels is supplied with a voltage exceeding another threshold of the chiral smectic liquid crystal to be written into a display state.

In the present invention, the data signal may have a voltage waveform including a first phase, a second phase and a third phase having mutually different peak values, and the second phase of the data signal may be synchronized with a second phase of the scanning selection signal.

In the present invention, the pixels on non-selected scanning electrode may be supplied with an AC voltage caused by the data signals, which AC voltage provides a time-average value of zero with reference to a voltage level of a non-selected scanning electrode.

In the present invention, the data signal applied in synchronism with the scanning selection signal may have voltages of mutually different peak values in the first phase, second phase and third phase, and the second phase voltage may have an average value of the first phase voltage and the third phase voltage.

The second phase voltage provides a voltage exceeding a threshold of the chiral smectic liquid crystal in combination with the scanning selection signal voltage.

The second phase may have a duration of $\Delta T$ which is equal to the total duration of the first phase and the third phase. The first and third phases may respectively have a duration of $\Delta T/2$.

The data signal applied in synchronism with the scanning selection signal may provide a time-average voltage which is zero with reference to a difference between the above-mentioned time-average of the AC voltage and the voltage level of a non-selected scanning electrode. The data signal may have voltages of mutually different peak values in the first, second and third phases. The second phase voltage is equal to an average of the first phase and third phase voltages. The second phase may have a duration of $\Delta T$ which is equal to the total duration of the first phase and the third phase. The first and third phases may respectively have a duration of $\Delta T/2$.

In the present invention, one of the substrates may be subjected to a uniaxial aligning treatment, and the other substrate may be subjected to a non-uniaxial aligning treatment (e.g., a random aligning treatment). Alternatively, the pair of substrates may comprise mutually different alignment control film, e.g., one of an organic film and the other of an inorganic film, both subjected to a uniaxial aligning treatment.

The chiral smectic liquid crystal may develop a ferroelectric phase or both of a ferroelectric and an anti-ferroelectric phase. The chiral smectic liquid crystal may include at least one liquid crystal component having a fluorinated carbon terminal group of, e.g., 2–15 carbon atoms, of which at least one carbon atom is completely fluorinated.

The drive means may apply scanning selection signals, including at least two successively applied scanning selections partially overlapping each other and applied to different scanning electrodes.

According to a further aspect of the present invention, there is provided a liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means including:

means for sequentially applying a scanning selection signal to the scanning electrodes to select at least one scanning electrode, and applying a data signal having at least three peak values to the data electrodes in synchronism with the scanning selection signal, means for applying a DC voltage between the scanning electrodes and the data electrodes, and means for switching a polarity of the DC voltage.

According to the present invention, there is further provided a liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means including:

means for sequentially applying a scanning selection signal to the scanning electrodes to select at least one scanning electrode, said scanning selection signal comprising voltages of at least a first phase and a second phase having mutually different peak values, and applying a data signal having at least three peak values to the data electrodes in synchronism with the scanning selection signal, so that in the first phase, the pixels on the selected scanning electrode are supplied with a voltage exceeding one threshold of the chiral smectic liquid crystal to be non-selectively reset to a cleared state and, in the second phase, a selected pixel among the cleared pixels is supplied with a voltage exceeding another threshold of the chiral smectic liquid crystal to be written into a display state;

means for applying a DC voltage between the scanning electrodes and the data electrodes; and means for switching a polarity of the DC voltage.

The data signal may have a waveform including a first phase, a second phase and a third phase, wherein the first and second phase have an identical first peak value, and the third phase has a second peak value different from the first peak value. The second phase of the data signal may be synchronized with the second phase of the scanning selection signal.

The drive means may apply scanning selection signals, including at least two successively applied scanning selections partially overlapping each other and applied to different scanning electrodes.

The drive means may apply the DC voltage to non-selected scanning electrode not receiving the scanning selection signal. The drive means may apply the DC voltage uniforming to the data electrodes.

The DC voltage may have a value in the range of $0.1V_0$–$5V_0$, preferably $0.5V_0$–$3V_0$, wherein $V_0$ denotes a maximum voltage of the data signal.

The polarity of the DC voltage may be changed for every vertical scanning period (one-frame scanning period or one-field scanning period).

The data signal may have three phases including a first phase, a second phase and a third phase, wherein the second phase may have a duration of $\Delta T$, and the first and third phases may respectively have a duration of $\Delta T/2$.

The pixels on non-selected scanning electrodes are supplied with an AC voltage due to the data signal applied thereto and the AC voltage provides a time-average identical to the DC voltage value.

In the present invention, one of the substrates may be subjected to a uniaxial aligning treatment, and the other substrate may be subjected to a non-uniaxial aligning treatment (e.g., a random aligning treatment). Alternatively, the pair of substrates may comprise mutually different alignment control films, e.g., one of an organic film and the other of an inorganic film, both subjected to a uniaxial aligning treatment.

The chiral smectic liquid crystal may develop a ferroelectric phase or both of a ferroelectric and an anti-ferroelectric phase. The chiral smectic liquid crystal may include at least one liquid crystal component having a fluorinated carbon terminal group of, e.g., 2–15 carbon atoms, of which at least one carbon atom is completely fluorinated.

The chiral smectic liquid crystal may be one causing a phase transition from isotropic phase to chiral smectic phase in a temperature range on temperature decrease.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 6A–6D, 8A–8D and 10A–10D are respectively a waveform diagram showing a set of voltage signals applied to the pixels based on the drive signals shown in FIGS. 5A–5D, 7A–7D and 9A–9D, respectively.

FIGS. 11A–11D through 13A–13D are three types of time-serial waveform diagrams obtained by using the drive signals shown in FIGS. 5A–5D.

DESCRIPTION OF THE PREFERRED EMBODIMENTS

Figure 1:
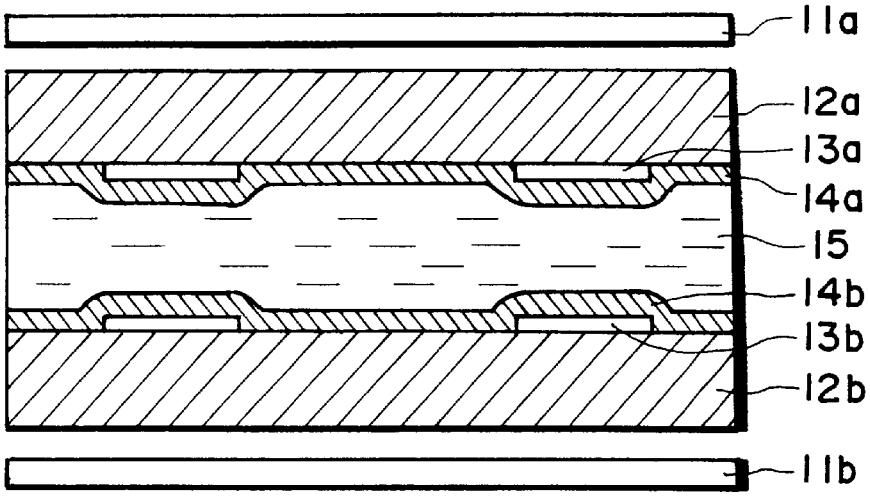
FIG. 1 is a sectional view of a chiral smectic liquid crystal panel used in the invention.

As a chiral smectic liquid crystal developing a ferroelectric state in the present invention, it is preferred to use a chiral smectic liquid crystal containing at least one liquid crystal component having a fluorinated carbon terminal group of, e.g., 2–15 carbon atoms, of which at least one carbon atom is completely carbonated. Specific examples of such a chiral smectic liquid crystal may include the following Compositions 1–4 disclosed in U.S. Pat. No. 5,377,033.

Composition 1

76.5% 5-octyl-2-(4-(1,1-dihydroperfluoro-2-(2-butoxyethoxy)ethoxy)phenyl)pyrimidine 4.5% 5-octyl-2-(4-(1,1-dihydroperfluorooctyloxy) phenyl)pyrimidine 4.5% 5-nonyl-2-(4-(1,1-dihydroperfluorooctyloxy) phenyl)pyrimidine 10.0% (S)-4-(2-chloro-4-methylpentanoyloxy)phenyl-4-(1,1-dihydroperfluorobutoxy)benzoate.

The transition temperature upon cooling from the isotropic state (I) to the crystalline state (K) are I-SmA: 73° C., SmA-SmC*: 30° C. and SmC*-K: ←10° C.

Herein SmA denotes smectic A phase, and SmC* denotes chiral smectic C phase.

Composition 2

12.44% 5-hexyl-2-(4-(1,1-dihydroperfluoro-2-(2-butoxyethoxy)ethoxy)phenyl)pyrimidine 20.74% 5-octyl-2-(4-(1,1-dihydroperfluorohexyloxy) phenyl)pyrimidine 20.74% 5-nonyl-2-(4-(1,1-dihydroperfluorohexyloxy) phenyl)pyrimidine 20.74% 5-decyl-2-(4-(1,1-dihydroperfluorohexyloxy) phenyl)pyrimidine 8.30% 5-decyl-2-(4-(1,1-dihydroperfluorobutoxy) phenyl)pyrimidine 7.21% (S)-4-(2-chloro-4-methylpentanoyloxy)phenyl 4-(1,1-dihydroperfluorobutoxy)benzoate 3.25% 2,3-dicyano-4-octyloxyphenyl-4-(1,1-dihydroperflorohexyloxy)benzoate 6.58% 2,3-difluoro-4-octyloxyphenyl 4-(1,1-dihydroperfluorohexyloxy)benzoate.

The transition temperatures upon cooling from the isotropic state (I) to the crystalline state (K) are I-SMA: 78° C., SmA-SmC*: 59° C. and SmC*-K: 12° C.

Composition 3

13.80% 5-hexyl-2-(4-(1,1-dihydroperfluoro-2-(2-butoxyethoxy)ethoxy)phenyl)pyrimidine 23.00% 5-octyl-2-(4-(1,1-dihydroperfluorohexyloxy) phenyl)pyrimidine 23.00% 5-nonyl-2-(4-(1,1-dihydroperfluorohexyloxy) phenyl)pyrimidine 9.20% 5-decyl-2-(4-(1,1-dihydroperfluorobutoxy) phenyl)pyrimidine 8.00% (S)-4-(2-chloro-4-methylpentanoyloxy)phenyl 4-(1,1-dihydroperfluorobutoxy)benzoate.

The transition temperatures upon cooling from the isotropic state (I) to the crystalline state (K) are I-SmA: 81° C., SmA-SmC*: 54° C. and SmC*-K: 10° C.

Composition 4

90% 5-octyl-2-(4-(1,1-dihydroperfluoro-2-(2-butoxyethoxy)ethoxy)phenyl)pyrimidine 10% 5-octyl-2-(4-((S)-(2-chloro-4-methylpentanoyloxy) phenyl)pyrimidine.

The transition temperatures upon cooling from the isotropic state (I) to the crystalline state (K) are I-SmA: 76° C., SmA-SmC*: 30° C. and SmC*-K: ←10° C.

Specific examples of the chiral smectic liquid crystal developing both a ferroelectric state and an anti-ferroelectric state may include the following compounds of formulae (1)–(10) indicated below together with their phase transition series, wherein K denotes a crystal phase, SmX denotes an unidentified phase, SmA denotes smectic A phase, I denotes isotropic phase, and $SmC_A$*, SmCr* and SmC* denote states in the chiral smectic C phase including $SmC_A$* showing a ferroelectric state under voltage application and an anti-ferroelectric state under no voltage application, SmC* showing a ferroelectric state under no voltage application and SmCr* which is an unidentified phase, respectively, when placed in a non-helical alignment state by suppressing the helical alignment structure inherent to the chiral smectic C phase.

(1)

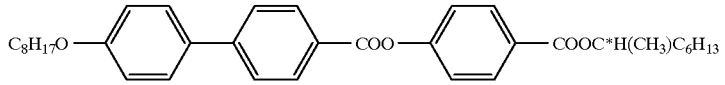

K 72.5 $SmC_A$* 117 SmC* 121.5 SmA 149.6 I ( °C.)

-continued (2)

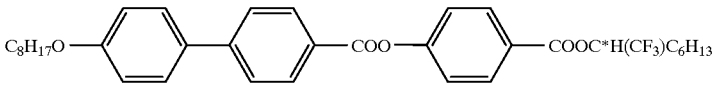

K 74 $SmC_A^*$ 114 SmC* 115 SmA 123 I (°C.)

(3)

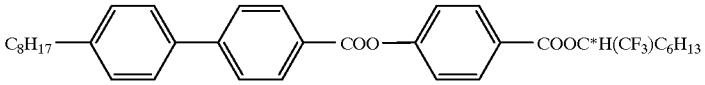

K 24.5 $SmC_A^*$ 74 SmC* 75.4 SmA 79.2 I (°C.)

(4)

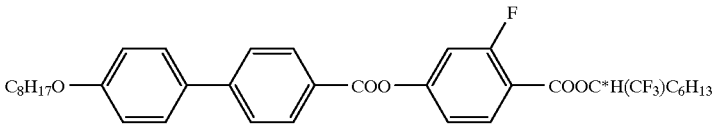

K -2 $SmC_A^*$ 110 SmA 112 I (°C.)

(5)

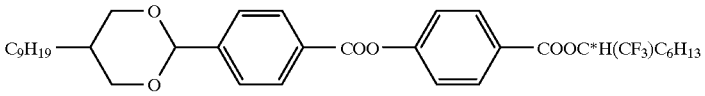

K 18 $SmC_A^*$ 70.4 SmC* 71.5 SmA 79.9 I (°C.)

(6)

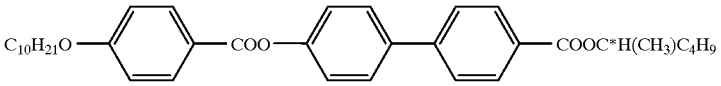

K 48 $SmC_A^*$ 73 $SmC_7^*$ 86 SmC* 106 SmA 134 I (°C.)

(7)

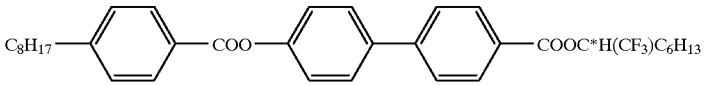

K -20 $SmC_A^*$ 38 SmC* 40 SmA 61.9 I (°C.)

(8)

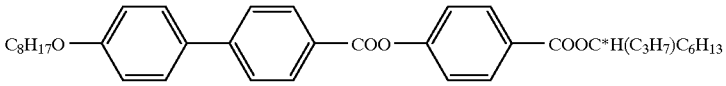

K 39.2 $SmC_A^*$ 87.0 SmA 103.2 I (°C.)

(9)

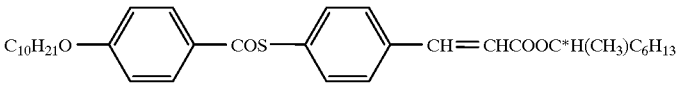

K 11 $SmC_A^*$ 31 SmX 53 SmA 72 I (°C.)

(10)

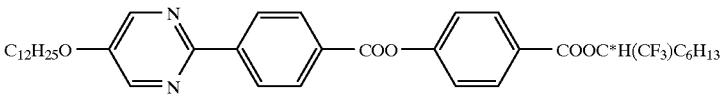

K 32 $SmC_A^*$ 97.0 SmA 104.0 I (°C.)

Specific examples of the liquid crystal device utilizing the anti-ferroelectricity may include those disclosed in U.S. Pat. No. 5,046,823, JP-A 6-95624, JP-A 6-202078 and JP-A 6-202082.

FIG. 1 is a schematic sectional view of a liquid crystal panel used in the present invention, including a pair of polarizers 11*a* and 11*b* disposed in cross nicols and sandwiching a panel (cell) structure including a pair of transparent substrates 12*a* and 12*b* of, e.g., glass, which are disposed to provide a spacing therebetween of, e.g., 1–5 μm, small enough to suppress the formation of a helical structure inherent to a chiral smectic liquid crystal.

The substrates 12*a* and 12*b* have thereon two groups of transparent electrodes 13*a* and 13*b*, respectively, one group being assigned as scanning electrodes (scanning lines) to which a scanning selection signal and a scanning non-selection signal are serially applied, and the other being assigned as data electrodes (data lines) to which data signals are applied in parallel.

The transparent electrodes 13*a* and 13*b* are coated with alignment control films 14*a* and 14*b* having mutually different alignment controlling characteristics. In this specific embodiment, only one alignment control film 14*a* is subjected to a uniaxial aligning treatment, such as rubbing or oblique vapor deposition, alignment control film 14*b* and the other is free from such a uniaxial alignment characteristic. Examples of the alignment control film 14*a* may include: aliphatic polyimide films subjected to rubbing disclosed in EP-A 450459, and polyimide films, polyamide films, polyamide-imide films and polyvinyl alcohol films, respectively subjected to rubbing disclosed in U.S. Pat. No. 4,639,089; and examples of the alignment control film 14*b* may include a laminate film of a sputtered $SiO_2$ film and a calcined film of an organosilane compound as described below disclosed in U.S. Pat. No. 4,622,721, and a film of an insulating inorganic material, such as silicon nitride, silicon carbide, boron nitride, cerium oxide, silicon oxide, or magnesium fluoride, provided with a non-uniaxial alignment characteristic disclosed in U.S. Pat. No. 4,763,995. In the present invention, it is also possible to compose the alignment control film 14*a* having a uniaxial alignment characteristic and the alignment control film 14*b* having no uniaxial alignment characteristic of an identical material (e.g., an identical polyimide or an identical polyamide).

Specific examples of organosilane compound (1) $CH_3—NH—(CH_2)_3—Si(OCH_3)_3$
(2) $NH_2—(CH_2)_2—NH—(CH_2)_3—Si(OCH_3)_3$ (3)

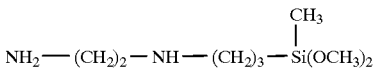

(4) $NH_2—(CH_2)_3—Si(OC_2H_5)_3$
(5) $Si(OC_2H_5)_4$, $CH_3—Si(OCH_3)_3$
(6) $CH_3—(CH_2)_4—Si(OC_2H_5)_3$ (7)

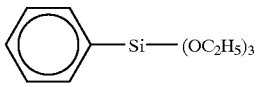

(8)

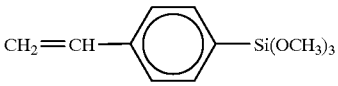

(9)

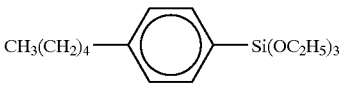

(10) $CH_3—(CH_2)_7—Si(OCH_3)_3$ (11)

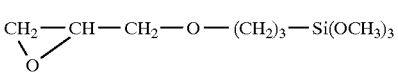

(12)

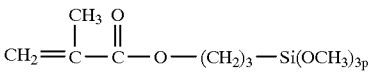

-continued

Specific examples of organosilane compound (13)

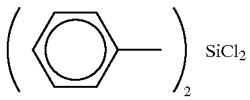

In a second embodiment of the asymmetric alignment structure, the alignment control films 14*a* and 14*b* are composed of different materials but are both subjected to a uniaxial aligning treatment, such as rubbing or oblique vapor deposition. For example, the alignment control film 14*a* may comprise a rubbed organic film of, e.g., polyimide film or polyamide film, and the alignment control film 14*b* may comprise a rubbed inorganic film, e.g., a calcined film of an organosilane compound as described above.

Between the alignment control films 14*a* and 14*b*, a chiral smectic liquid crystal 15 as described above is disposed. The chiral smectic liquid crystal is prevented from developing its own helical structure due to a boundary effect of the substrates 12*a* and 12*b*, and thus formed in a non-helical structure. The chiral smectic liquid crystal may preferably develop two stable alignment states in the case of a liquid crystal developing a ferroelectric state without developing an anti-ferroelectric state in the non-helical structure, and may preferably develop three stable alignment states in the case of a liquid crystal developing both a ferroelectric state and an anti-ferroelectric state. In a liquid crystal panel developing the above-mentioned two stable alignment states, the pair of cross nicol polarizers 11*a* and 11*b* are disposed so as to provide an extinction position (darkest state) when the liquid crystal is placed in one of the two stable alignment states. On the other hand, in a liquid crystal panel developing the above-mentioned three stable alignment states, the pair of cross-nicol polarizers 11*a* and 11*b* are disposed to provide an extinction position (darkest state) when the liquid crystal is placed in the anti-ferroelectric state and provide a bright state in the ferroelectric state.

Figure 2:
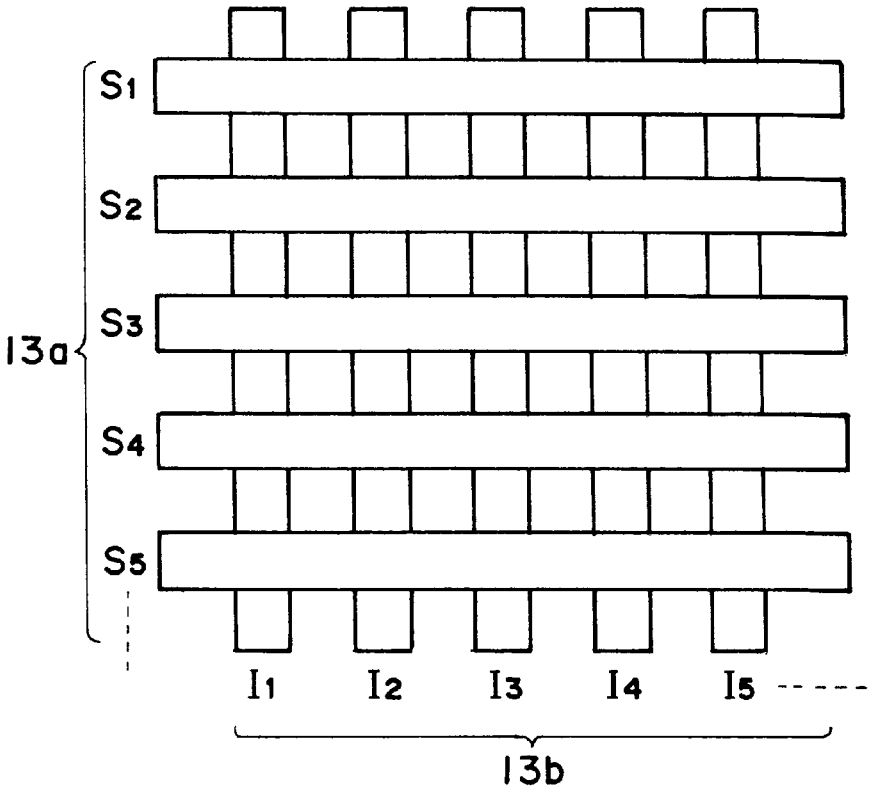
FIG. 2 is a schematic plan view of a matrix electrode structure used in the present invention.

FIG. 2 is a plan view of an electrode matrix, composed of scanning electrodes 13*a* (scanning lines $S_1$, $S_2$, $S_3$, . . . ) and data electrodes 13*b* (data lines $I_1$, $I_2$, $I_3$, . . . ).

Figure 3:
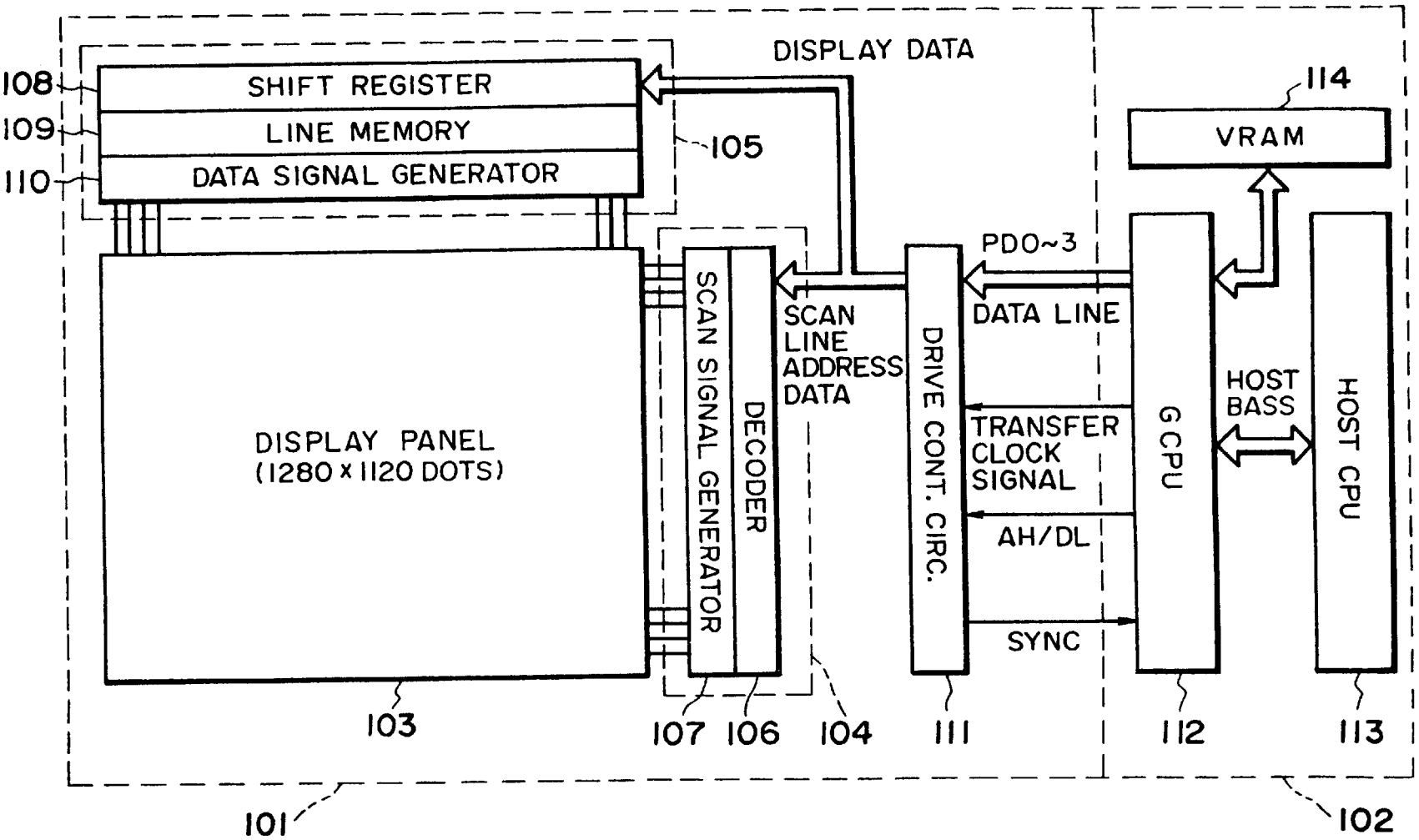
FIG. 3 is a block diagram of an embodiment of the liquid crystal apparatus of the invention.
Figure 4:
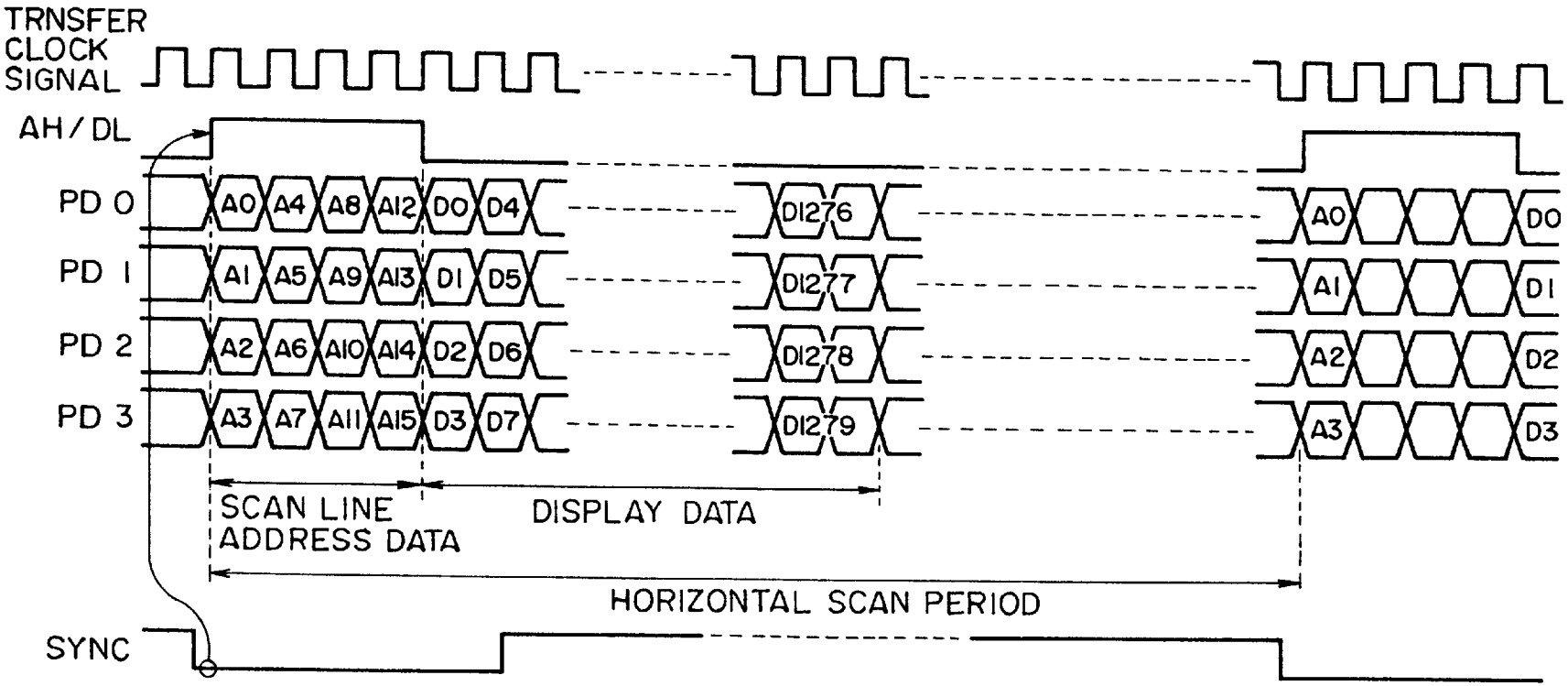
FIG. 4 is a time chart for image data communication used in the apparatus of FIG. 3.
Figures 5A, 5B, 5C, 5D:
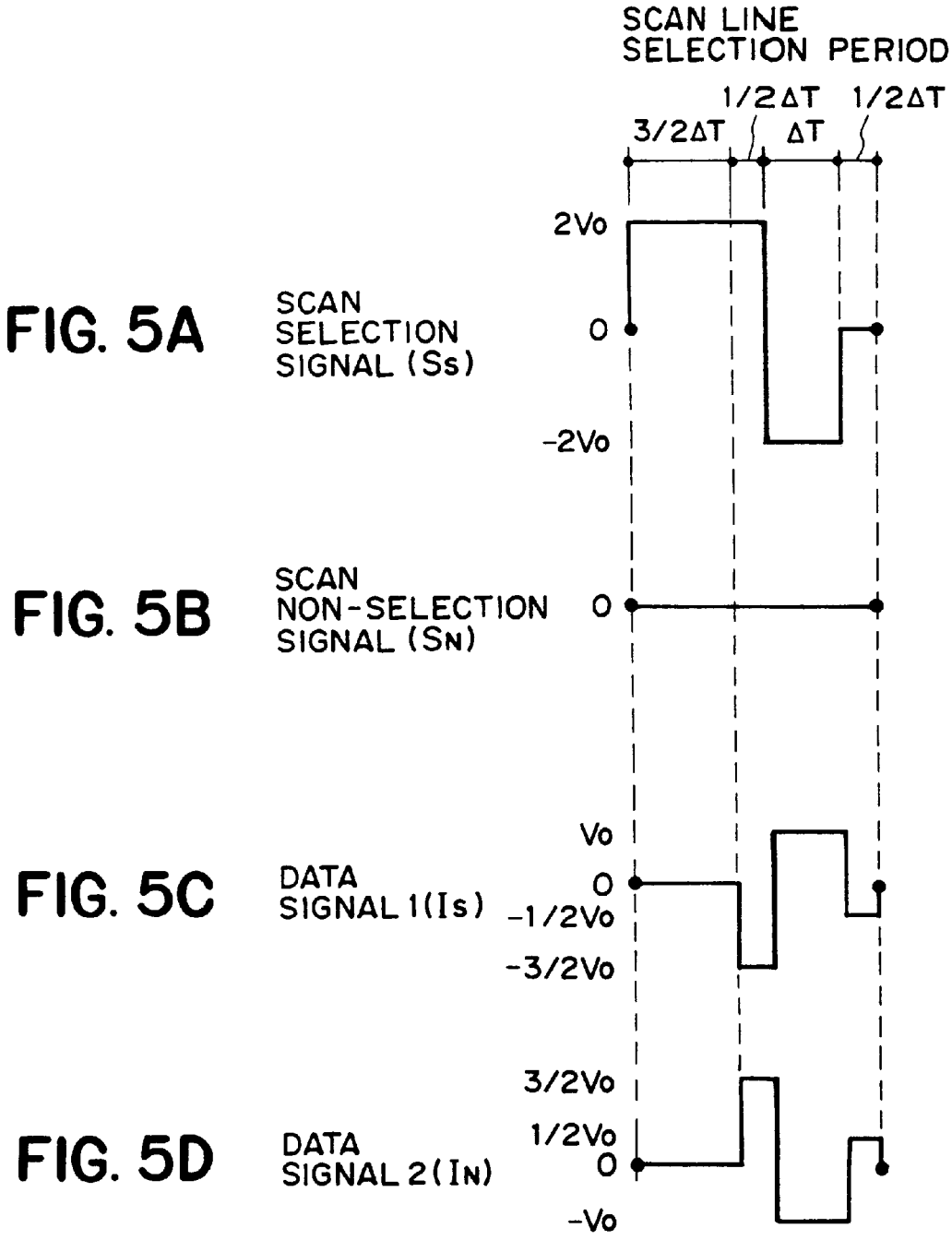
FIGS. 5A–5D, 7A–7D and 9A–9D are respectively a waveform diagram showing a set of drive signals applied to the electrodes used in the invention.
Figures 6A, 6B, 6C, 6D:
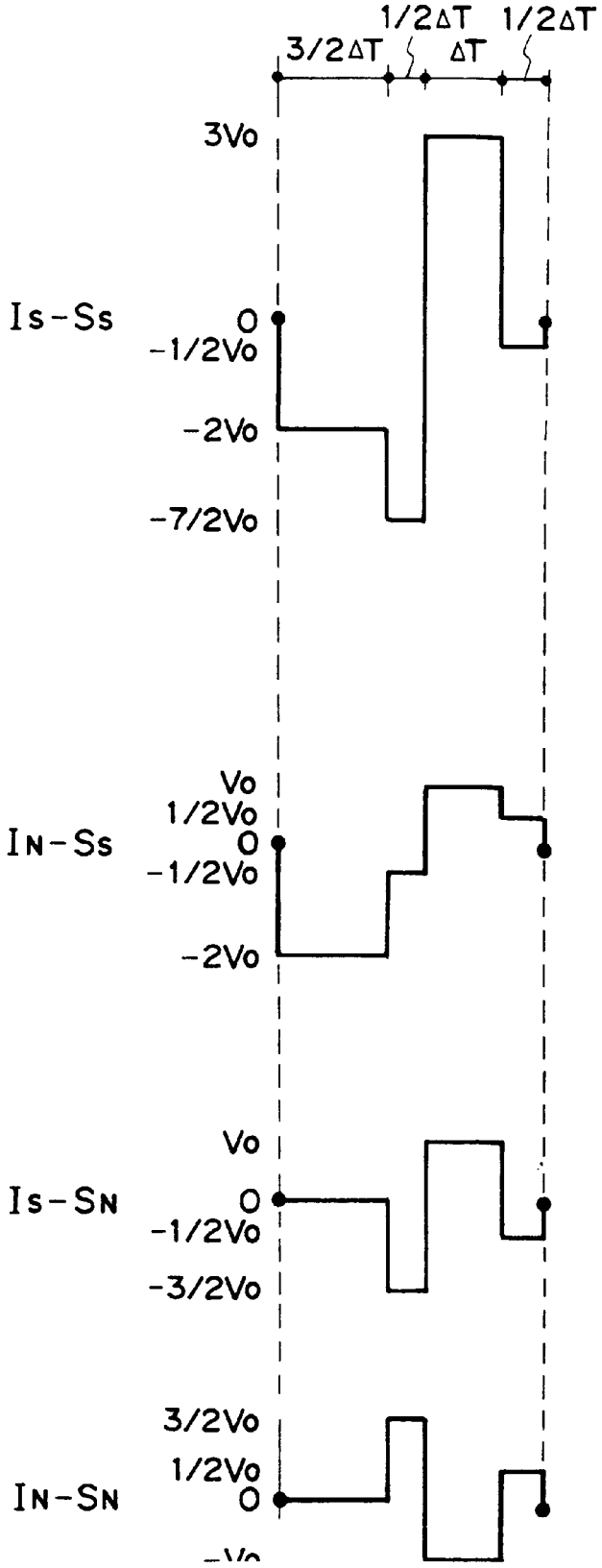
Figures 7A, 7B, 7C, 7D:
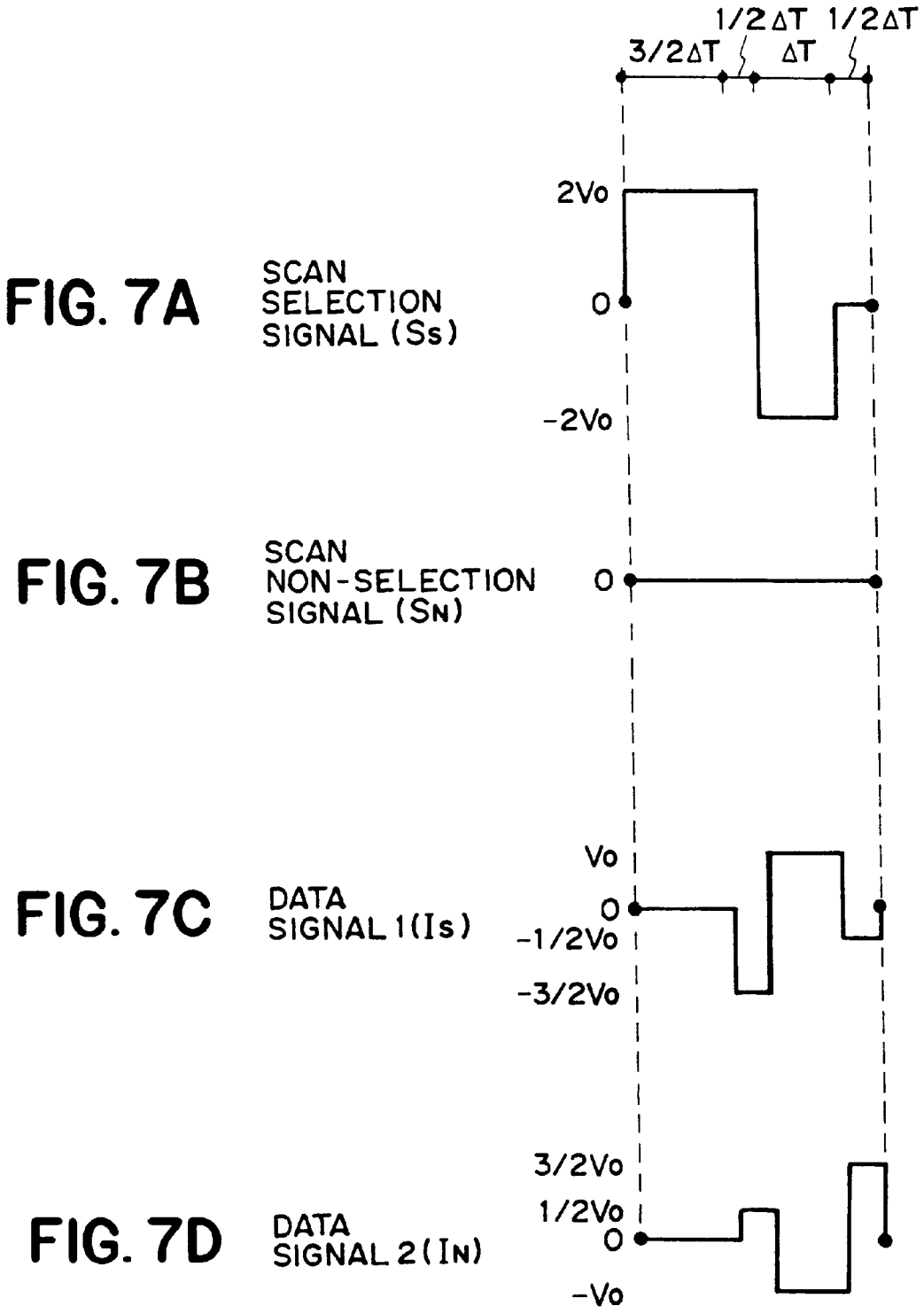
Figures 8A, 8B, 8C, 8D:
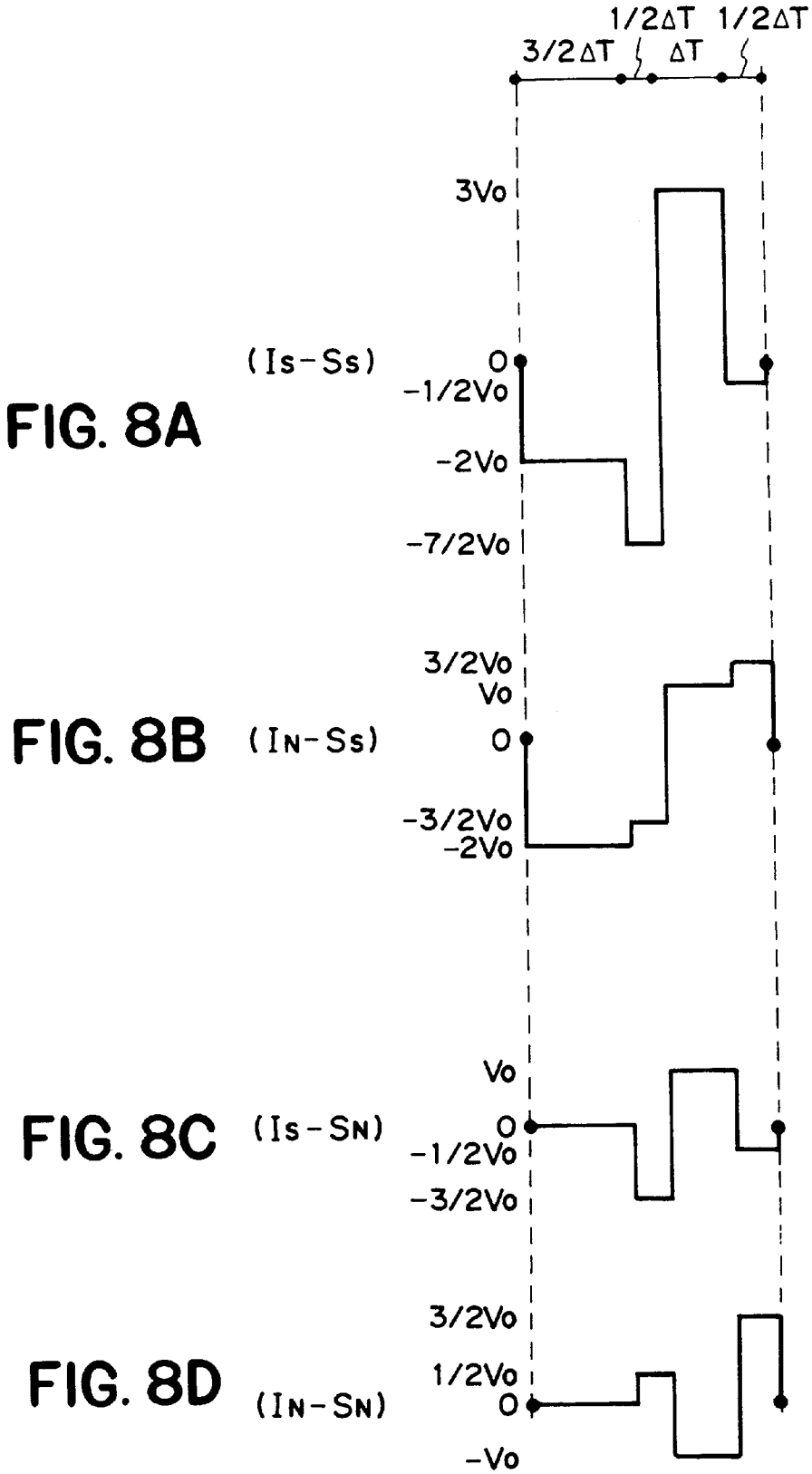
Figures 9A, 9B, 9C, 9D:
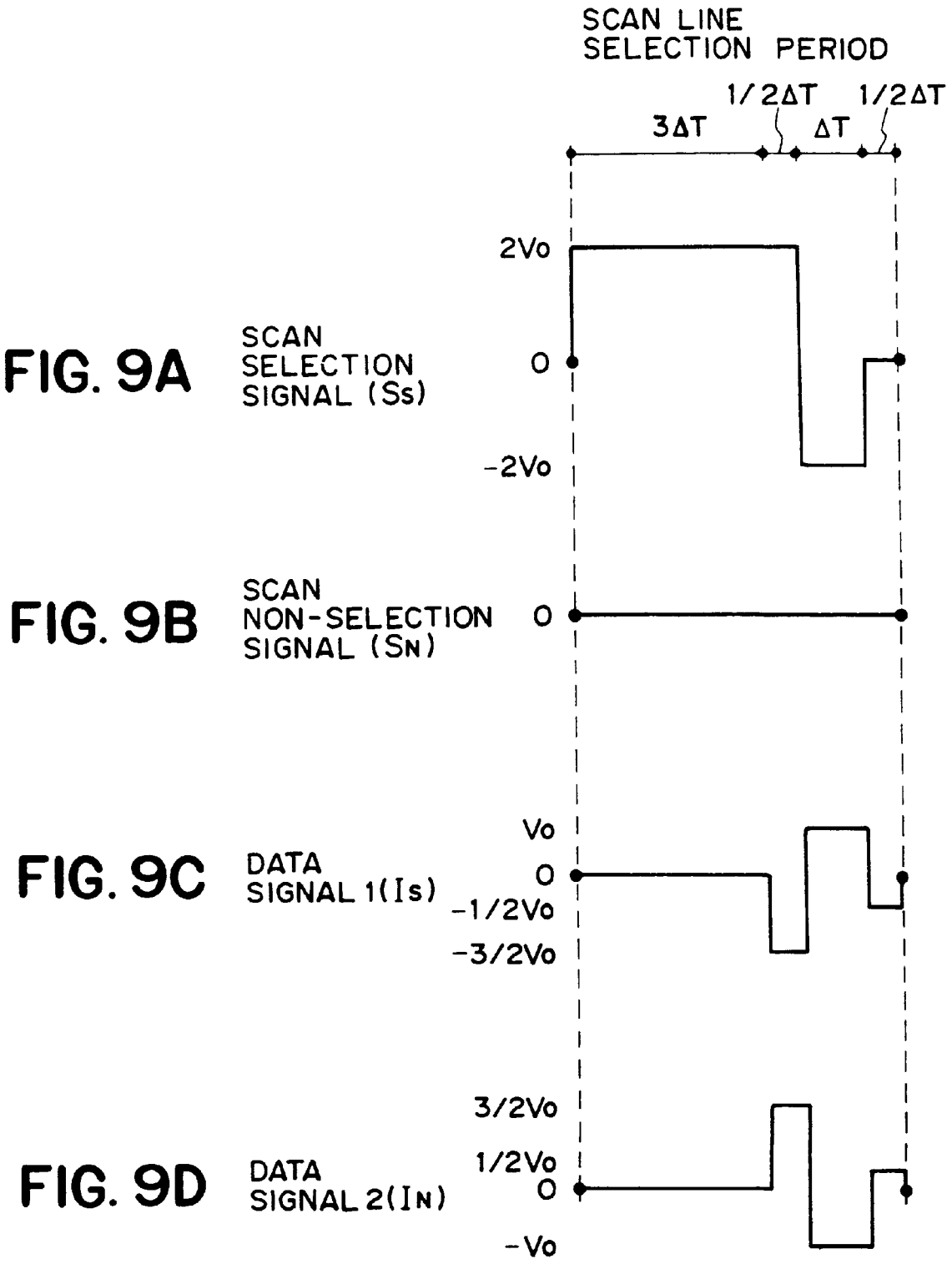
Figures 11A, 11B, 11C, 11D:
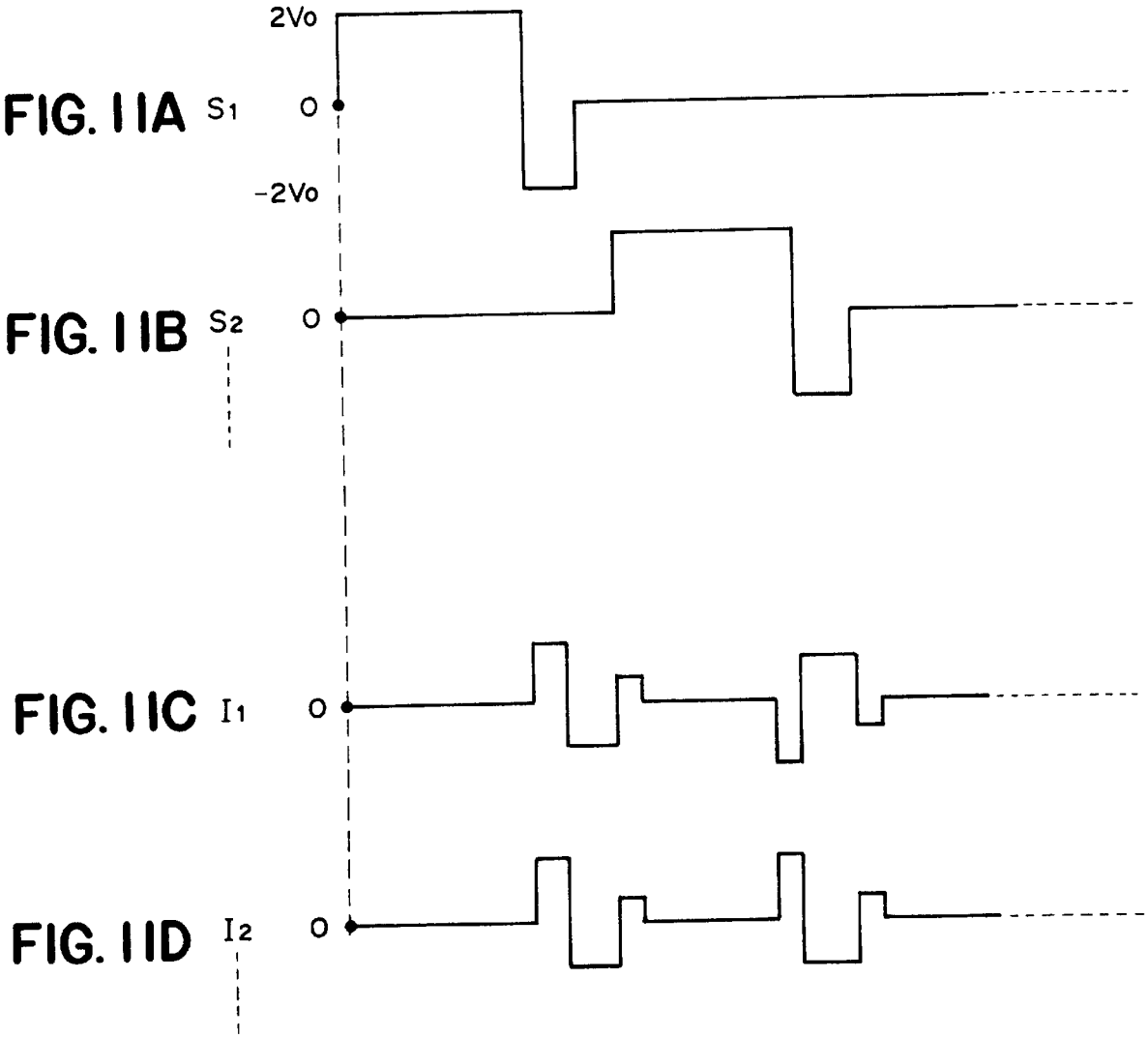
Figures 12A, 12B, 12C, 12D:
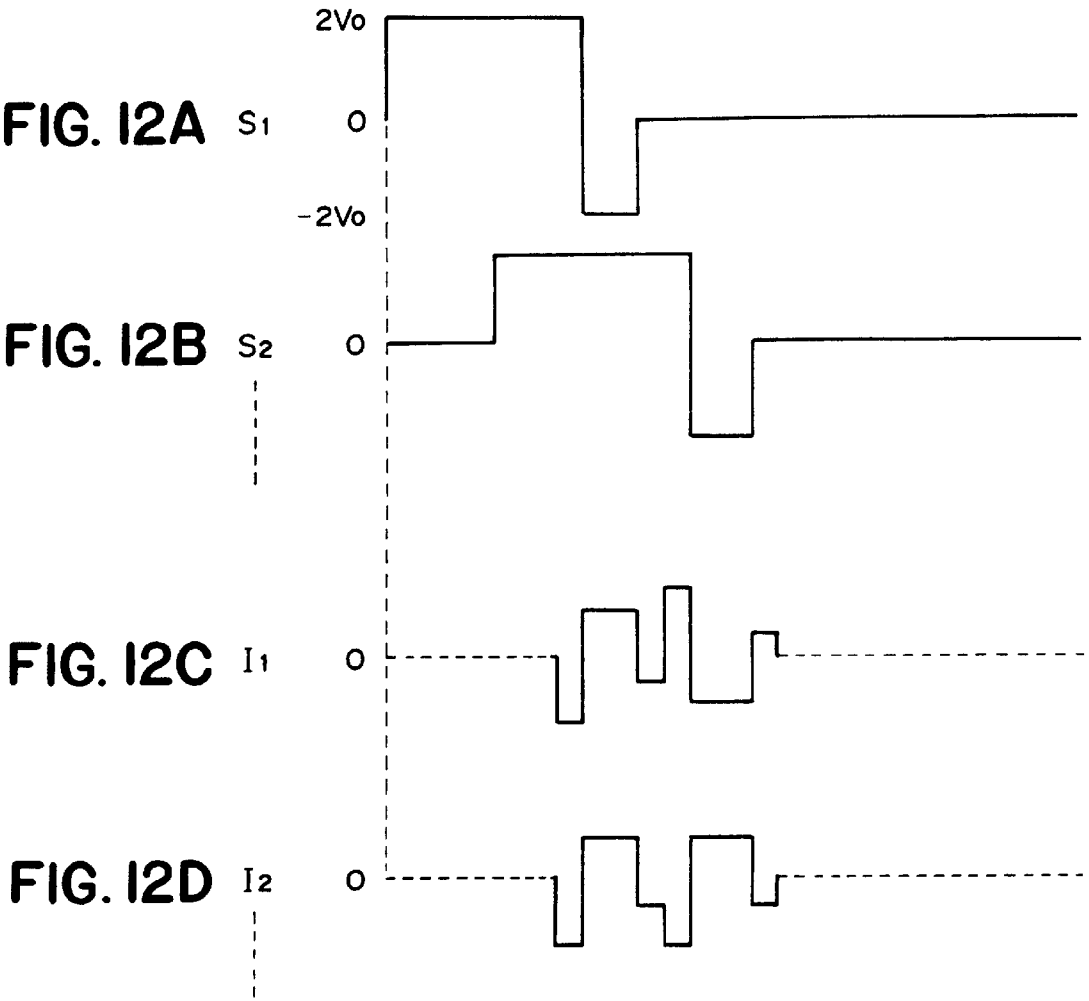
Figures 14A, 14B, 14C, 14D:
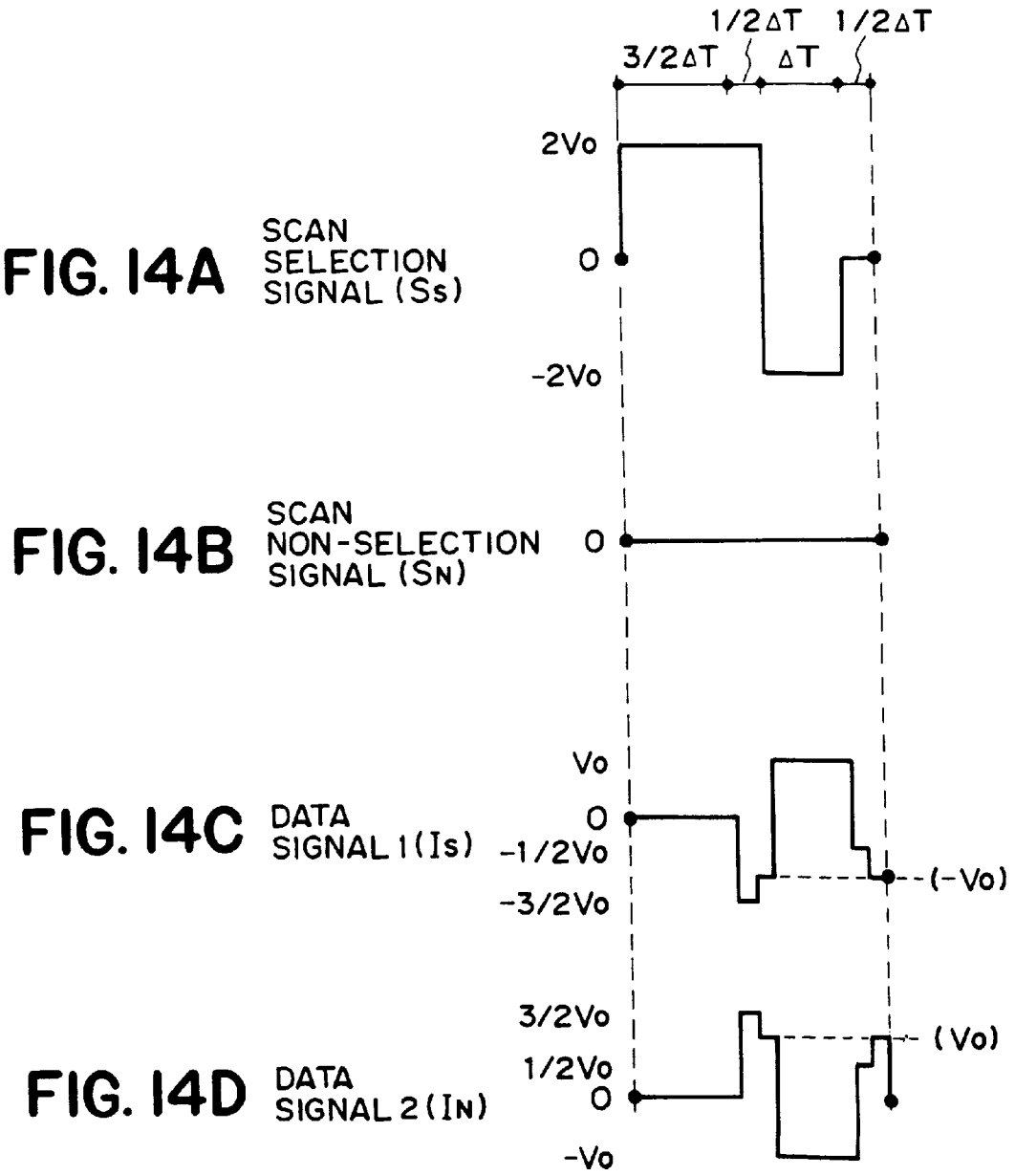
FIGS. 14A–14D constitute a waveform diagram showing another set of drive signals.
Figures 15A, 15B, 15C, 15D:
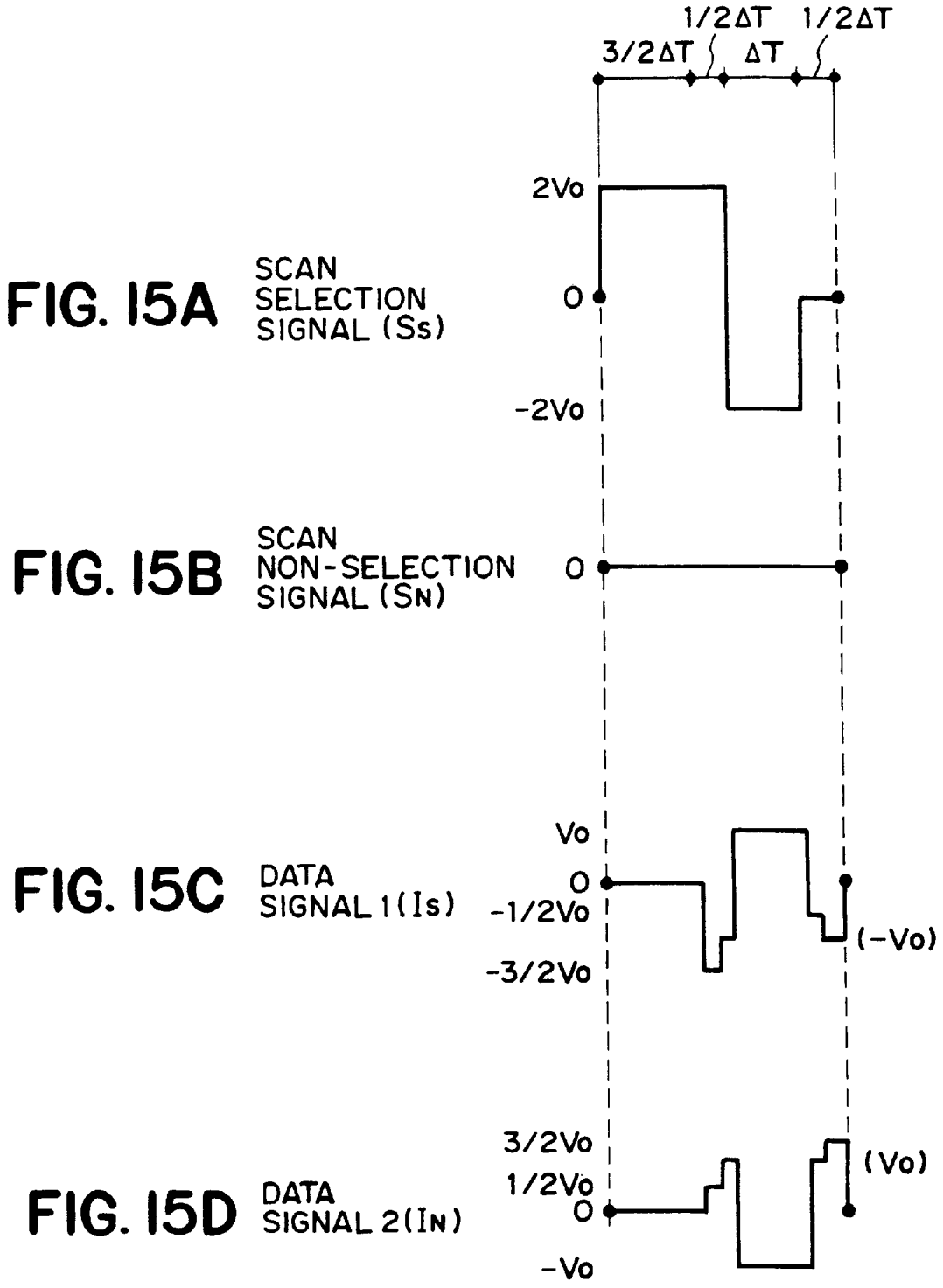
FIGS. 15A–15D is a waveform diagram showing a set of drive voltages applied to the pixels based on the drive signals shown in FIGS. 14A–14D.
Figures 16A, 16B, 16C, 16D:
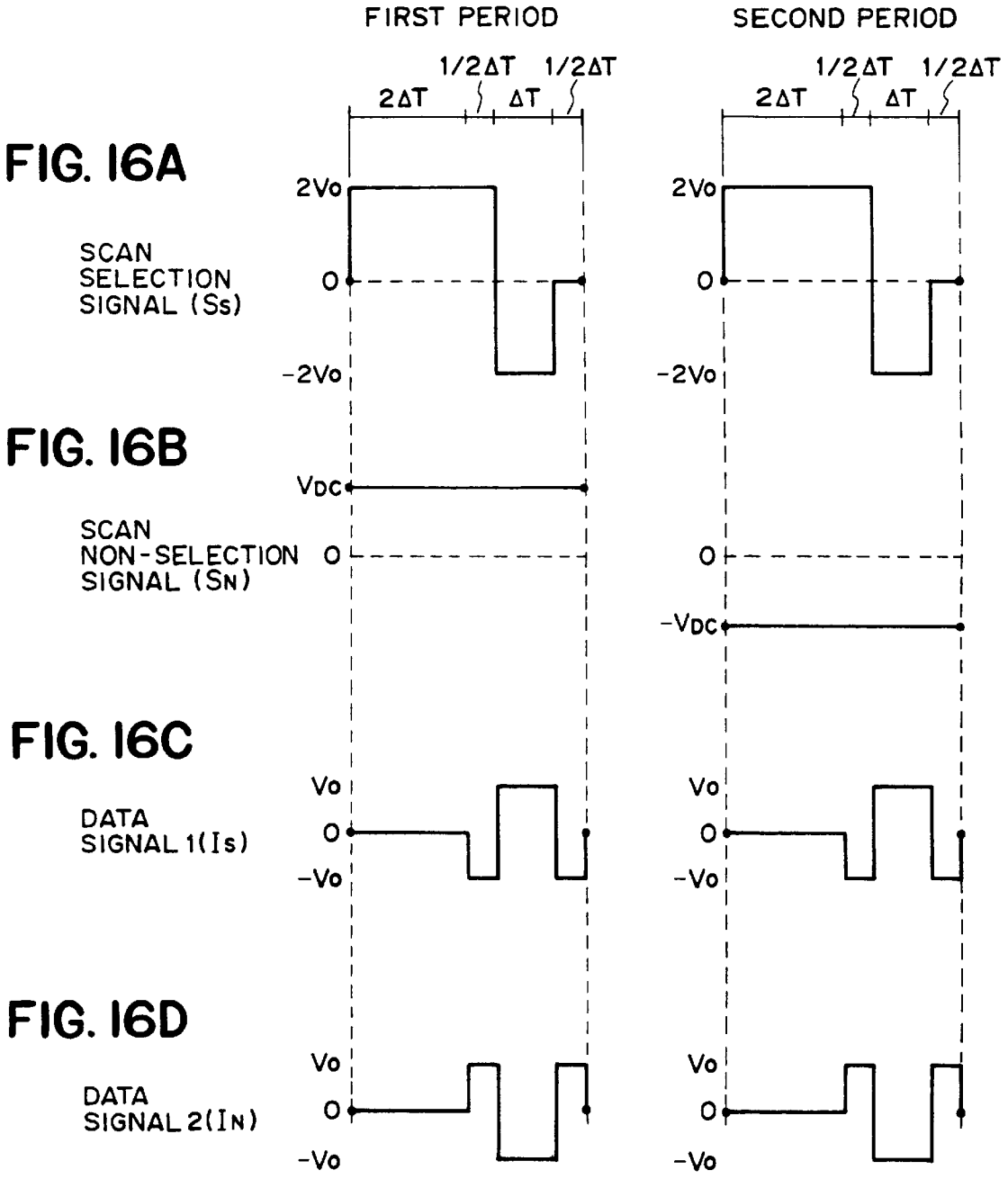
FIGS. 16A–16D and 17A–17D are respectively a waveform diagram showing another set of drive signals applied to the electrodes.
Figures 17A, 17B, 17C, 17D:
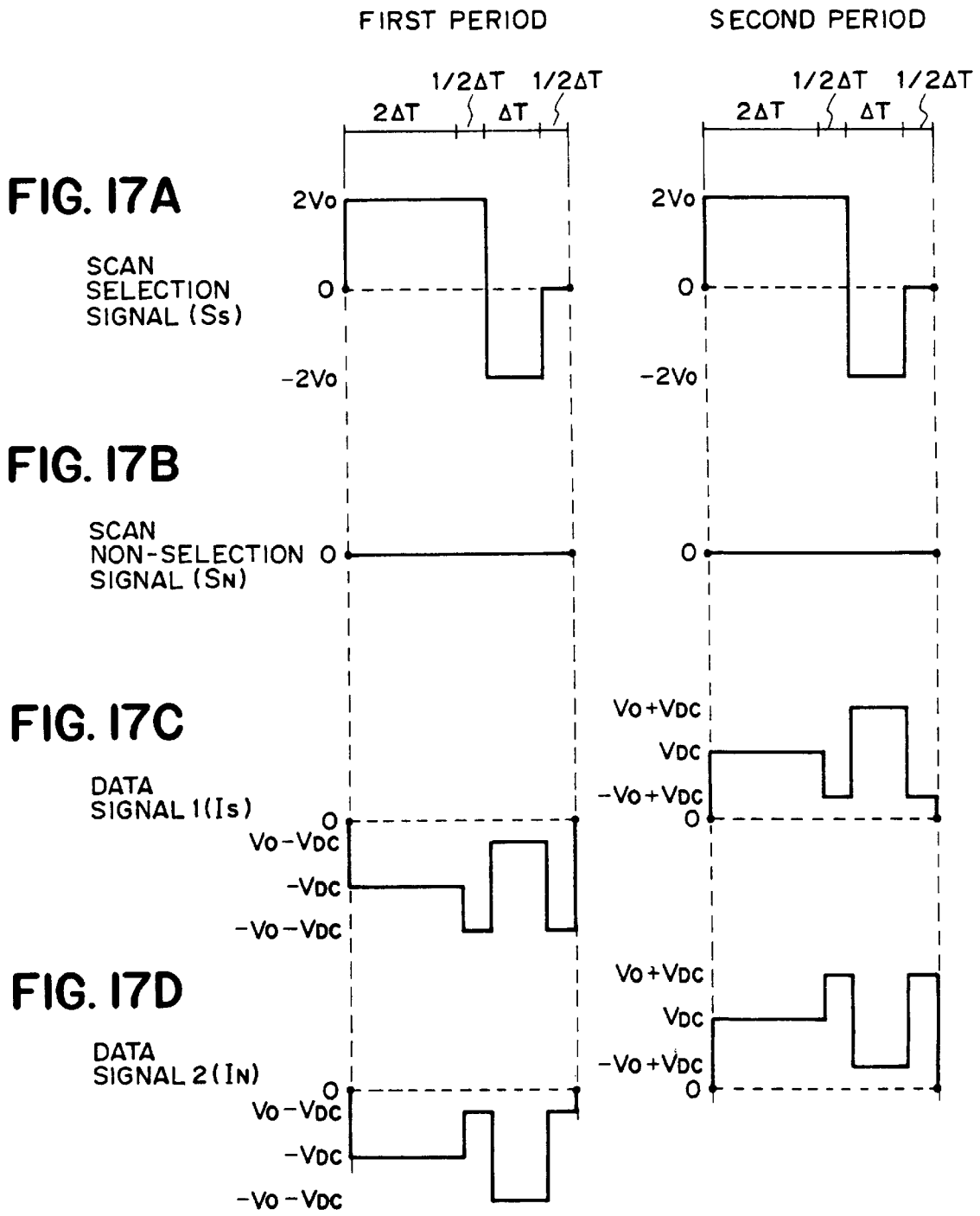
Figures 18A, 18B, 18C, 18D:
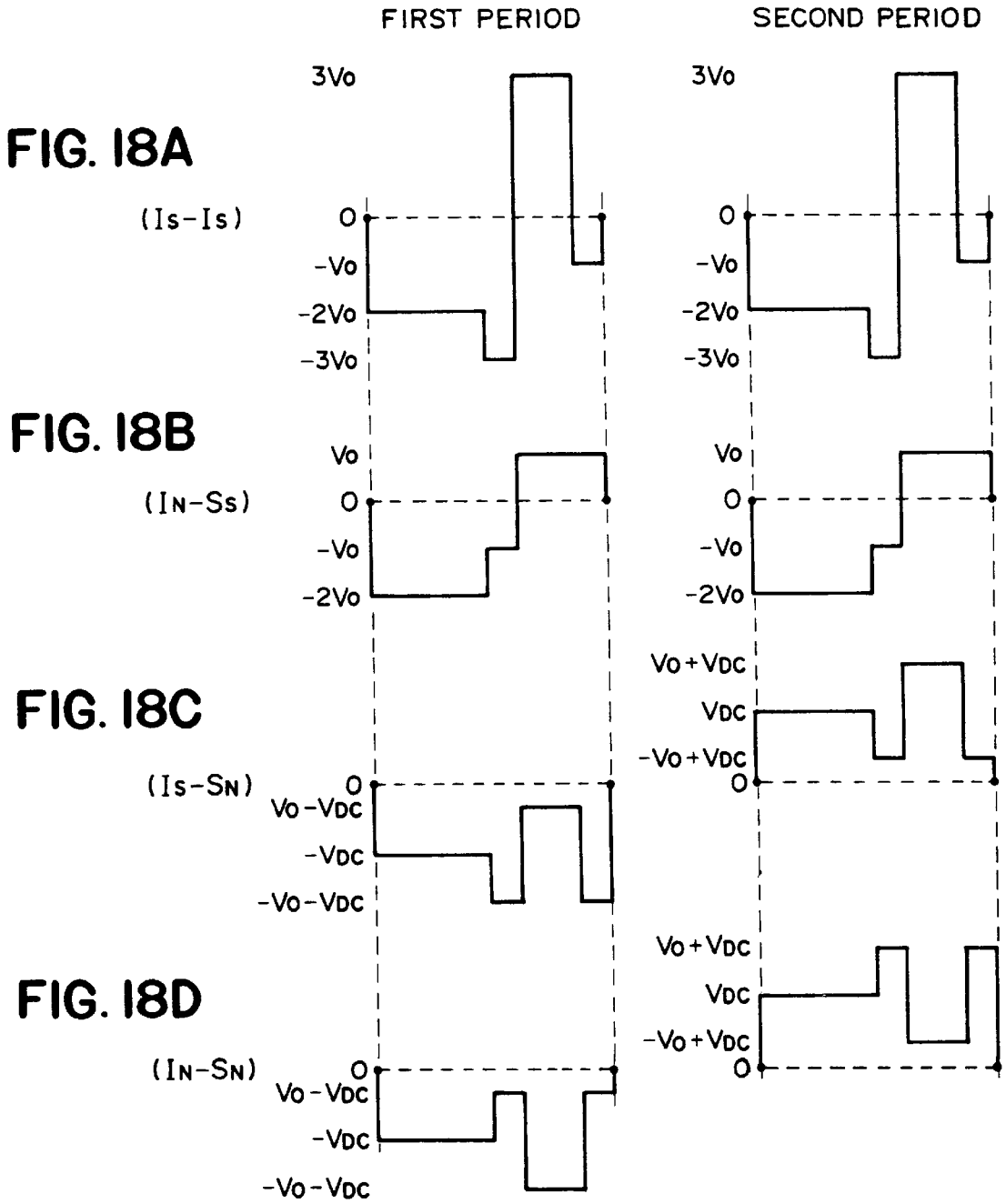
FIGS. 18A–18D constitute a waveform diagram showing a set of drive voltages applied to the pixels based on the signals shown in FIGS. 16A–16D or 17A–17D.
Figures 19A, 19B, 19C, 19D:
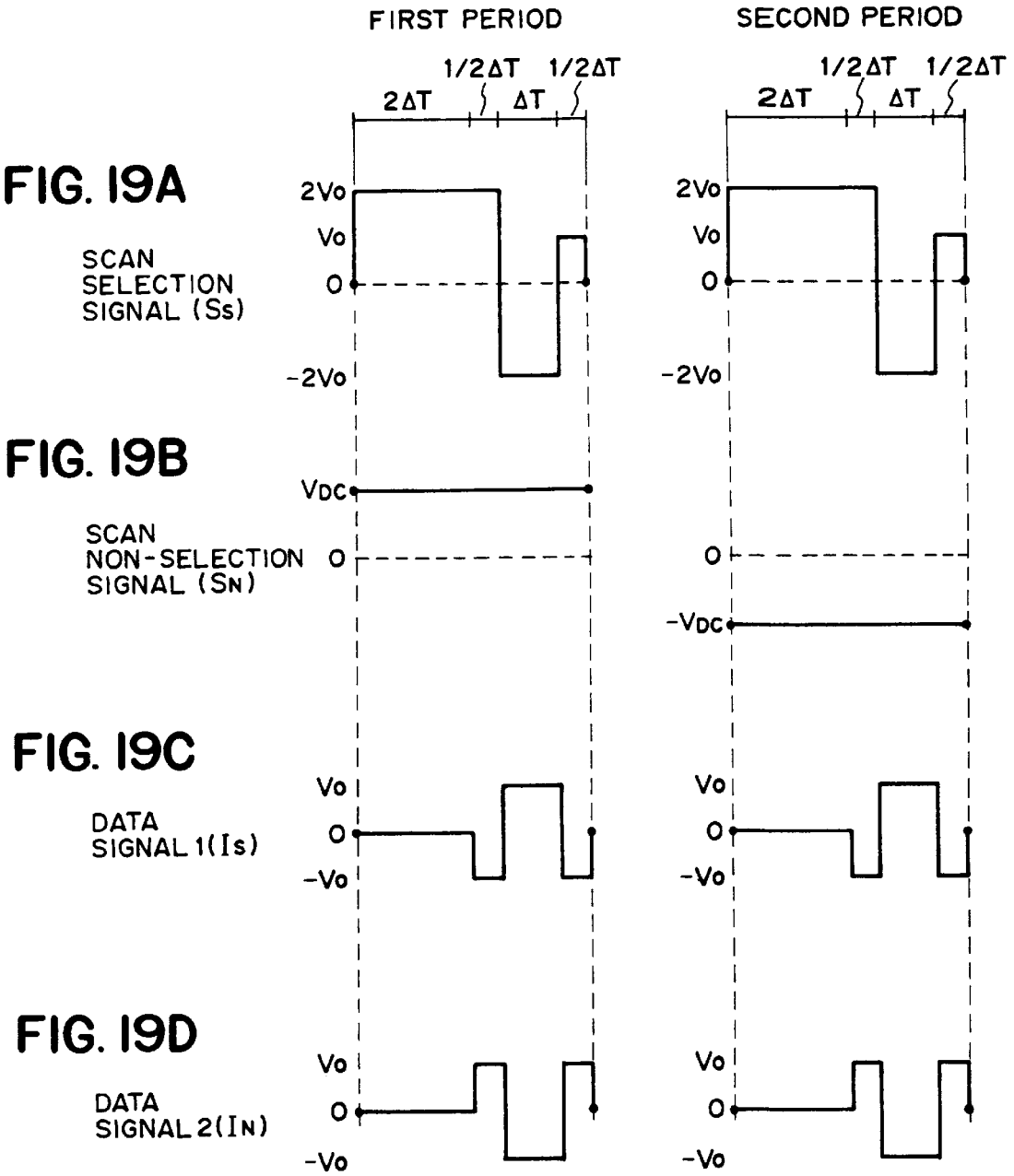
FIGS. 19A–19D and 20A–20D are respectively a waveform diagram showing another set of drive signals applied to the electrodes.

FIG. 3 is a block diagram showing an arrangement of a ferroelectric liquid crystal display apparatus 101, and a graphic controller 102 which is provided in an apparatus body, such as a personal computer, as a display data supply source. FIG. 4 is a time chart for image data communication between the display apparatus 101 and the graphic controller 102 shown in FIG. 3. The display apparatus 101 includes a liquid crystal panel 103 having 1120 scanning electrodes and 1280 data electrodes arranged in a matrix, between which a ferroelectric liquid crystal is sealed up. The scanning electrodes and the data electrodes are connected to a scanning line drive circuit 104 and a data line drive circuit 105, respectively.

Hereinbelow, the operation of the display apparatus is described with reference to FIGS. 3 and 4. The graphic controller 102 supplies scanning line address data for designating a scanning line and image data (PD0–PD3) on the scanning line designated by the address data to a display drive circuit 104/105 (composed of a scanning line drive circuit 104 and a data line drive circuit 105) of the liquid crystal display apparatus 101. In this embodiment, the image data comprising the scanning line address data and the display data are transferred through the same transmission line, so that it is necessary to differentiate the above-mentioned two types of data. For the differentiation, a signal AH/DL is used. The AH/DL signal at a high level means scanning line address data, and the AH/DL signal at a low level means display data.

In the liquid crystal display apparatus 101, the scanning line address data are extracted from transferred image data PD0–PD3 by a drive control circuit 111 and then supplied to the scanning line drive circuit 104 in synchronism with a time for driving a designated scanning line. The scanning line address data are inputted to a decoder 106 in the scanning line drive circuit 104, and a designated scanning line in the display panel 103 is driven by a scanning signal generating circuit 107 with the aid of the decoder 106. On the other hand, the display data are introduced to a shift register 108 in the data line drive circuit 105 and shifted by a unit of 4 pixel data based on a transfer clock signal. When the shift of display data for one horizontal scanning line is completed by the shift register 108, the display data for 1280 pixels are transferred to a line memory disposed in parallel, memorized for a period of one horizontal scanning and are supplied to the respective data lines as display data signals through a data signal generating circuit 110.

Further, in this embodiment, the drive of the display panel 103 in the liquid crystal display apparatus 101 is not synchronized with the generation of the scanning line address data and display data in the graphic controller 102, so that it is necessary to synchronize the apparatus 101 and 102 at the time of image data transfer. A signal SYNC is in charge of the synchronization and is generated in the drive control circuit 111 in the liquid crystal display apparatus 101 at each one horizontal scanning period. The graphic controller 102 always monitors the SYNC signal, and transfers image data when the SYNC signal is at a low level and does not effect transfer after completing transfer of image data for one horizontal scanning line when the SYNC signal is at high level. More specifically, referring to FIG. 2, the graphic controller 102 immediately sets the AH/DL signal at high level and starts transfer of image data for one horizontal scanning line when it detects that the SYNC signal is at low level. The drive control circuit 111 in the liquid crystal display apparatus 101 set to the SYNC signal at high level during the image data transfer period. When the writing in the display panel 103 is completed after a prescribed one horizontal scanning period, the drive controller circuit (FLCD controller) 111 returns the SYNC signal to the low level so that it can receive image data for a subsequent scanning line.

FIGS. 5A–5D show a set of drive signals outputted from the scanning line drive circuit 104 and the data line drive circuit 105 including a scanning selection signal ($S_S$), a scanning non-selection signal ($S_N$), a data signal 1 ($I_S$) and a data signal 2 ($I_N$). The scanning selection signal $S_S$ has two polarity voltages of $2V_0$ and $-2V_0$ with reference to the voltage level of the scanning non-selection signal $S_N$. A former half period of $3\Delta T/2$ (period of voltage $2V_0$) of the scanning selection signal is used as a clearing (or reset) period, and a latter half period of $\Delta T$ (period of voltage $-2V_0$) is used as a writing period. The scanning selection signal further includes a period of $\Delta T/2$ (period of voltage $2V_0$) between the clearing period and the writing period, and a last period of $\Delta T/2$ (period of voltage 0) for making an average of the data signals 1 and 2 zero. The data signal 1 includes a former $\Delta T/2$ period (first phase) of voltage $-3V_0/2$, a latter $\Delta T/2$ period (third phase) of voltage $-V_0/2$, and a $\Delta T$ period (second phase) of voltage $V_0$ so that it provides an average voltage of zero. The data signal 2 has a waveform which is in anti-phase with the data signal 1.

At $I_S$-$S_S$ and $I_N$-$S_S$ in FIGS. 6A–6D are shown combinations of the scanning selection signal with the data signal 1 and the data signal 2, respectively, in FIGS. 5A–5D. Further, at $I_S$-$S_N$ and $I_N$-$S_N$ in FIGS. 6A–6D are shown combinations of the scanning non-selection signal with the data signal 1 and the data signal 2, respectively, in FIGS. 5A–5D.

The scanning selection signal may be sequentially applied to the scanning electrodes 13*a* one at a time (non-interlaced scanning) or with skipping of one or more electrodes (interlaced scanning). Particularly, in the case of repetitive scanning operation, the interlaced scanning mode may preferably be adopted. Further, when a demand for data rewriting on a display picture occurs as by a keyboard input, it is preferred to effect the non-interlaced scanning only for the scanning electrodes constituting the rewriting region in the display picture and effect the interlaced scanning for the scanning electrodes for the remaining non-rewriting region.

Combined signals $I_S$-$S_S$ and $I_N$-$S_S$ include a period of $3\Delta T/2$ in which a voltage exceeding one threshold voltage of the chiral smectic liquid crystal is applied, whereby the pixels on the selected scanning line are brought to one orientation state (e.g., one corresponding to a dark state) and the previously written states are cleared (reset) in this period. In the present invention, such a clearing period can also be $2\Delta T$, $2.5\Delta T$, $3\Delta T$ or an even longer period. In the period of $\Delta T/2$ subsequent to the clearing period and corresponding to an auxiliary signal application period, the pixels on the selected scanning line are supplied with a voltage of $-7V_0/2$ or $-V_0/2$. The auxiliary signal application period is provided in combination with a final auxiliary signal application period of $\Delta T/2$ so that the pixels on non-selected scanning lines receive an AC voltage waveform. The period $\Delta T$ between the two auxiliary signal application period is a writing period, in which a voltage $3V_0$ exceeding another threshold voltage of the chiral smectic liquid crystal is selectively applied to pixels to provide another orientation state (e.g., one corresponding to a bright state) at the selected pixels and a voltage $V_0$ not exceeding the threshold voltage of the chiral smectic liquid crystal is applied to the other non-selected pixels so that the orientation state formed in the clearing period is retained at the non-selected pixels.

FIGS. 7A–7D show another set of drive signals used in another embodiment, which are identical to those shown in FIGS. 5A–5D except for a different second data signal $I_N$. FIGS. 8A–8D show a set of combined signals (voltage signals applied to pixels) based on the drive signals shown in FIGS. 7A–7D.

FIGS. 9A–9D show still another set of drive signals used in another embodiment, which are identical to those shown in FIGS. 5A–5D except that the length of the clearing period is changed to $3\Delta T$. FIGS. 10A–10D show a set of combined signals (voltage signals applied to pixels) based on the drive signals shown in FIGS. 9A–9D.

FIGS. 11A–11D and 12A–12D are respectively a time-serial waveform showing a succession of the scanning selection signal shown in FIGS. 9A–9D in parallel with some data signals. In the embodiment of FIGS. 12A–12D, a drive at a high frame frequency (e.g., of 15 Hz or higher) becomes possible even when the number of scanning lines is 1000 or larger. In the embodiment of FIGS. 12A–12D, no zero voltage period is used. In each of the embodiments of FIGS. 11A–11D and 12A–12D, the pixels on non-selected scanning lines are supplied with an AC voltage which becomes zero on a time-average.

On the other hand, a liquid crystal panel of the type utilizing a ferroelectric state and an anti-ferroelectric state of a chiral smectic liquid crystal may be driven by setting the voltages in the clearing period and the former auxiliary signal application period respectively to be zero and providing a DC component to the scanning non-selection signal in each of the sets of drive signals shown in FIGS. 5A–5D, 7A–7D and 9A–9D. In this instance, it is desirable to invert the polarities of the DC component and the voltage in the writing period of the scanning selection signal for each frame. A specific example of such drive signals may assume a time-serial waveform as shown in FIGS. 13A–13D by modifying the drive signals shown in FIGS. 9A–9D.

In each of the embodiments of FIGS. 11A–11D, 12A–12D and 13A–13D, the data signal applied in synchronism with the scanning signal provides a time average value which is zero with reference to a difference between the time-average of the AC voltage applied to the pixels on a non-selected scanning line and the voltage level of such a non-selected scanning line. Each data signal has different peak values in the first, second and third phases such that the second phase voltage is identical to the average of the first and third phase voltages. The combination of the second phase voltage and the scanning selection signal voltage provides a voltage exceeding a threshold voltage of the chiral smectic liquid crystal. The second phase period (ΔT) is equal to the total (ΔT) of the first and third phase periods. Further, the above-mentioned difference between the time-average of the AC voltage applied to the pixels on a non-selected scanning line and the voltage level of such a non-selected scanning line, is zero in the embodiments of FIGS. 11A–11D and 12A–12D, and is equal to the DC component ($\pm 2V_0$) in the embodiment of FIG. 13.

In the present invention, the time-serial waveforms shown in FIGS. 11A–11D through 13A–13D obtained based on the drive signals shown in FIGS. 9A–9D may be modified by using the drive signals shown in FIGS. 5A–5D or FIGS. 7A–7D.

FIGS. 14A–14D and 15A–15D show two sets of drive signals obtained by modifying the sets of drive signals of FIGS. 5A–5D and 7A–7D, respectively, by using data signals each having three levels of peak values (in terms of absolute value). More specifically, in FIGS. 14A–14D and 15A–15D, a data signal $I_S$ has there peak values of $\pm V_0$, $-V_0/2$ and $-3_0/2$, and a data signal $I_N$ has three peak values of $\pm V_0$, $V_0/2$ and $3V_0/2$. Each data signal has a former and a latter auxiliary period each divided into sub-periods of ΔT/4 having different peak values.

In the present invention, the molecular perturbation becomes different at the beginning and the end of one horizontal scanning period in a non-selection period, so that it becomes difficult for a liquid crystal molecule to remain at one orientation state. As a result, even when a chiral smectic liquid crystal having a spontaneous polarization of 10 $nC/cm^2$ or larger is used, the occurrence of "sticking" phenomenon with time in the case of continuous matrix-drive display operation for a long period can be sufficiently alleviated or suppressed.

Next, some embodiments of inverting the polarity of a bias electric field at a prescribed frequency at the time of non-selection will be described. The application of a simple bias electric field at the time of non-selection is disclosed in JP-A 62-28717 and JP-A 62-260125. The simple application of such a bias electric field application technique cannot solve the sticking problem. In the present invention, the direction or polarity of such a bias electric field at a prescribed frequency to solve the sticking problem.

FIGS. 16A–16D, 17A–17D, 18A–18D, 19A–19D and 20A–20D respectively show a set of drive signals outputted from the scanning line drive circuit 104 and the data line drive circuit 105 of the apparatus shown in FIG. 3, including a scanning selection signal $S_S$, a scanning non-selection signal $S_N$, a first data signal $I_S$ and a second data signal $I_N$. The scanning selection signal $S_S$ has two polarity voltages of $2V_0$ and $-2V_0$ with reference to the voltage level of the scanning non-selection signal $S_N$.

In the embodiments of FIGS. 16A–16D and 17A–17D, a former half period of 2ΔT (period of voltage $2V_0$) of the scanning selection signal is used as a clearing (or reset) period, and a latter half period of ΔT (period of voltage $-2V_0$) is used as a writing period in synchronism with a second phase of the data signals $I_S$ and $I_N$. The scanning selection signal further includes a period of ΔT/2 (period of voltage $2V_0$) between the clearing period and the writing period, and a last period of ΔT/2 (period of voltage 0) in synchronism with the first phase and the third phase, respectively, of the data signals $I_S$ and $I_N$, which are provided as auxiliary signal application periods.

In the embodiment of FIGS. 16A–16D, a scanning electrode not supplied with a scanning selection signal $S_S$ is supplied with a scanning non-selection signal $S_N$ comprising a DC voltage $V_{DC}$ of $+1.5V_0$ or $-1.5V_0$. Each of a first period and a second period may be repeated for one frame scanning period or one field scanning period (vertical scanning period), or set to one horizontal scanning period. Correspondingly, the polarity of the DC voltage $V_{DC}$ is switched after continuation for a corresponding period.

In the embodiment of FIGS. 17A–17D, a DC voltage $D_{DC}$ of $+1.5V_0$ or $-1.5V_0$ is uniformly applied to the data electrodes. Also in the embodiment of FIGS. 17A–17D, each of a first period and a second period may be repeated for one frame scanning period or one field scanning period (vertical scanning period), or set to one horizontal scanning period. Correspondingly, the polarity of the DC voltage $V_{DC}$ is switched after continuation for a corresponding period.

In FIGS. 18A–18D, at $I_S$-$S_S$ and $I_N$-$S_S$ are shown pixel signals (voltage signals applied to pixels) obtained by combinations of the scanning selection signal $S_S$ and the data signals $I_S$ and $I_N$, respectively, in FIGS. 16A–16D or FIGS. 17A–17D; and at $I_S$-$S_N$ and $I_N$-$S_N$ are shown pixel signals obtained by combinations of the scanning non-selection signal $S_N$ and the data signals $I_S$ and $I_N$, respectively, in FIGS. 16A–16D or FIGS. 17A–17D.

The scanning selection signal $S_S$ may be sequentially applied to the scanning electrodes 13*a* one at a time (non-interlaced scanning) or with skipping of one or more electrodes (interlaced scanning). Particularly, in the case of repetitive scanning operation, the interlaced scanning mode may preferably be adopted. Further, when a demand for data rewriting on a display picture occurs as by a keyboard input, it is preferred to effect the non-interlaced scanning only for the scanning electrodes constituting the rewriting region in the display picture and effect the interlaced scanning for the scanning electrodes for the remaining non-rewriting region.

Combined signals $I_S$-$S_S$ and $I_N$-$S_S$ include a period of 2ΔT in which a voltage exceeding one threshold voltage of the chiral smectic liquid crystal is applied, whereby the pixels on the selected scanning line are brought to one orientation state (e.g., one corresponding to a dark state) and the previously written states are cleared (reset) in this period. In the present invention, such a clearing period can also be 1.5ΔT, 2.5ΔT, 3ΔT or an even longer period. In the period of ΔT/2 subsequent to the clearing period and corresponding to an auxiliary signal application period. The auxiliary signal application period is provided in combination with a final auxiliary signal application period of ΔT/2 so that the pixels on non-selected scanning lines receive an AC voltage waveform. The period ΔT between the two auxiliary signal application period is a writing period, in which a voltage $3V_0$ exceeding another threshold voltage of the chiral smectic liquid crystal is selectively applied to pixels to provide another orientation state (e.g., one corresponding to a bright state) at the selected pixels and a voltage $V_0$ not exceeding the threshold voltage of the chiral smectic liquid crystal is applied to the other non-selected pixels so that the orientation state formed in the clearing period is retained at the non-selected pixels.

FIGS. 19A–19D and 20A–20D show other sets of drive signals used in other embodiments which are identical to drive signals shown in FIGS. 16A–16D and 17A–17D, respectively, except that the voltage at the final ΔT/2 period was changed from zero to $V_0$. It has been confirmed that such modification is effective for providing a larger drive margin during display drive. FIGS. 21A–21D show a set of pixel signals obtained by using any set of drive signals shown in FIGS. 19A–19D or FIG. 20.

FIGS. 22A–22D and 23A–23D show two types of time-serial drive signal waveform obtained by applying the scanning selection signal shown in FIGS. 16A–16D in different manners (i.e., without and with overlapping of consecutively applied scanning selection signals). According to the embodiment of FIGS. 23A–23D, a drive at a high frame frequency (e.g., 15 Hz or higher) can be realized even if the number of scanning lines exceeds 1000. In the embodiment shown in FIGS. 23A–23D wherein a pair of consecutive scanning selection signals having a partial overlapping with each other are applied to different scanning electrodes, the period of voltage zero is omitted from the data signals. In the embodiments of FIGS. 22A–22D and 23A–23D, a DC voltage of $V_{DC}$ is applied as a scanning non-selection signal, and pixels on scanning electrodes at the time of scanning non-selection receive AC voltages having a time-average value equal to the DC voltage $V_{DC}$. The polarity of the DC bias voltage $V_{DC}$ is inverted for each frame scanning period.

FIGS. 24A–24D and 25A–25D show two types of time-serial drive signal waveform obtained by applying the scanning selection signal shown in FIG. 17 in different manners (i.e., without and with overlapping of consecutively applied scanning selection signals). According to the embodiment of FIG. 25, a drive at a high frame frequency (e.g., 15 Hz or higher) can be realized even if the number of scanning lines exceeds 1000. In the embodiment shown in FIGS. 25A–25D wherein a pair of consecutive scanning selection signals having a partial overlapping with each other are applied to different scanning electrodes, the period of voltage zero is omitted from the data signals. In the embodiments of FIGS. 24A–24D and 25A–25D, a DC voltage of $V_{DC}$ is applied as a scanning non-selection signal, and pixels on scanning electrodes at the time of scanning non-selection receive AC voltages having a time-average value equal to the DC voltage $V_{DC}$. The polarity of the DC bias voltage $V_{DC}$ is inverted for each frame scanning period.

As described above, in the present invention, the direction of bias electric field applied to the liquid crystal is inverted for each prescribed period, so that it becomes difficult for liquid crystal molecules to remain in one state. As a result, even if a display operation according to a matrix drive scheme is performed for a long period by using a chiral smectic liquid crystal having a large spontaneous polarization of at least 10 nC/cm$^2$, the "sticking" phenomenon with time can be sufficiently alleviated or suppressed.

What is claimed is:

1. A liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means for:

sequentially applying a scanning selection signal to the scanning electrodes to select at least one scanning electrode, and applying a data signal having at least three mutually different peak values, with reference to a voltage level of a scanning non-selection signal applied to non-selected scanning electrodes, to the data electrodes in synchronism with the scanning selection signal, said data signal having said at least three peak values within a period of applying the scanning selection signal.

2. An apparatus according to claim 1, wherein pixels on a scanning electrode not receiving the scanning selection signal are supplied with an AC voltage caused by the data signal, the AC voltage having a time-average of zero with reference to a voltage level of the scanning electrode not receiving the scanning selection signal.

3. An apparatus according to claim 1, wherein the data signal applied in synchronism with the scanning selection signal has a first phase, a second phase and a third phase having voltages of mutually different peak values, the voltage of the second phase being equal to an average of the voltages of the first and third phases.

4. An apparatus according to claim 1, wherein the data signal applied in synchronism with the scanning selection signal has a first phase, a second phase and a third phase having voltages of mutually different peak values, the voltage of the second phase being equal to an average of the voltages of the first and third phases, the voltage of the second phase providing a voltage exceeding a threshold of the chiral smectic liquid crystal in combination with the scanning selection signal voltage.

5. An apparatus according to claim 4, wherein the second phase has a period of ΔT, and the first and third phases have a total period of ΔT.

6. An apparatus according to claim 5, wherein the first and third phases respectively have a period of ΔT/2.

7. An apparatus according to claim 1, wherein pixels on a scanning electrode not receiving the scanning selection signal are supplied with an AC voltage caused by the data signal;

the data signal applied in synchronism with the scanning signal provides a time-average value which is zero with reference to a difference between the time-average of the AC voltage applied to the pixels on a non-selected scanning line and the voltage level of such a non-selected scanning line;

the data signal applied in synchronism with the scanning selection signal has a first phase, a second phase and a third phase having voltages of mutually different peak values, the voltage of the second phase being equal to an average of the voltages of the first and third phases, the voltage of the second phase providing a voltage exceeding a threshold of the chiral smectic liquid crystal in combination with the scanning selection signal voltage, the second phase having a period of ΔT, and the first and third phases having a total period of ΔT.

8. An apparatus according to claim 7, wherein said difference is zero.

9. An apparatus according to claim 7, wherein said difference makes a DC component.

10. An apparatus according to claim 7, wherein the first and third phases respectively have a period of ΔT/2.

11. An apparatus according to claim 10, wherein said difference is zero.

12. An apparatus according to claim 10, wherein said difference makes a DC component.

13. An apparatus according to claim 1, wherein only one of said pair of substrates is provided with a uniaxial alignment characteristic and the other substrate is provided with a non-uniaxial alignment characteristic.

14. An apparatus according to claim 13, wherein said non-uniaxial alignment characteristic is a random alignment characteristic.

15. An apparatus according to claim 1, wherein said pair of substrates have alignment control films thereon composed of different film materials and respectively having a uniaxial alignment characteristic.

16. An apparatus according to claim 15, wherein one of the alignment control films comprises an organic film, and the other comprises an inorganic film.

17. An apparatus according to claim 1, wherein said chiral smectic liquid crystal is a liquid crystal developing a ferroelectric state.

18. An apparatus according to claim 1, wherein said chiral smectic liquid crystal is a liquid crystal developing both a ferroelectric state and an anti-ferroelectric state.

19. An apparatus according to claim 1, wherein said chiral smectic liquid crystal comprises at least one liquid crystal component having a fluorinated carbon terminal group including least one completely fluorinated carbon atom.

20. An apparatus according to claim 19, wherein said fluorinated carbon terminal group has 2–15 carbon atoms.

21. An apparatus according to claim 1, wherein said chiral smectic liquid crystal includes a temperature region where smectic A phase is developed from isotropic phase on temperature decease, and said chiral smectic liquid crystal comprises at least one liquid crystal component having a fluorinated carbon terminal group including least one completely fluorinated carbon atom.

22. An apparatus according to claim 21, wherein said fluorinated carbon terminal group has 2–15 carbon atoms.

23. A liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means for:

sequentially applying a scanning selection signal to the scanning electrodes to select at least one scanning electrode, said scanning selection signal comprising voltages of at least a first phase and a second phase having mutually different peak values, and applying a data signal having at least three mutually different peak values, with reference to a voltage level of a scanning non-selection signal applied to non-selected scanning electrodes, to the data electrodes in synchronism with the scanning selection signal, said data signal having said at least three peak values within a period of applying the scanning selection signal, so that in the first phase, the pixels on the selected scanning electrode are supplied with a voltage exceeding one threshold of the chiral smectic liquid crystal to be non-selectively reset to a cleared state and, in the second phase, a selected pixel, among the cleared pixels is supplied with a voltage exceeding another threshold of the chiral smectic liquid crystal to be written into a display state.

24. An apparatus according to claim 23, wherein said data signal has a voltage waveform including a first phase, a second phase and a third phase having mutually different peak values, and the second phase of the data signal is synchronized with the second phase of the scanning selection signal.

25. An apparatus according to claim 23, wherein pixels on a scanning electrode not receiving the scanning selection signal are supplied with an AC voltage caused by the data signal, the AC voltage having a time-average of zero with reference to a voltage level of the scanning electrode not receiving the scanning selection signal.

26. An apparatus according to claim 23, wherein the data signal applied in synchronism with the scanning selection signal has a first phase, a second phase and a third phase having voltages of mutually different peak values, the voltage of the second phase being equal to an average of the voltages of the first and third phases.

27. An apparatus according to claim 23, wherein the data signal applied in synchronism with the scanning selection signal has a first phase, a second phase and a third phase having voltages of mutually different peak values, the voltage of the second phase being equal to an average of the voltages of the first and third phases, the voltage of the second phase providing a voltage exceeding a threshold of the chiral smectic liquid crystal in combination with the scanning selection signal voltage.

28. An apparatus according to claim 27, wherein the second phase has a period of ΔT, and the first and third phases have a total period of ΔT.

29. An apparatus according to claim 28, wherein the first and third phases respectively have a period of ΔT/2.

30. An apparatus according to claim 23, wherein pixels on a scanning electrode not receiving the scanning selection signal are supplied with an AC voltage caused by the data signal;

the data signal applied in synchronism with the scanning signal provides a time-average value which is zero with reference to a difference between the time-average of the AC voltage applied to the pixels on a non-selected scanning line and the voltage level of such a non-selected scanning line; and the data signal applied in synchronism with the scanning selection signal has a first phase, a second phase and a third phase having voltages of mutually different peak values, the voltage of the second phase being equal to an average of the voltages of the first and third phases, the voltage of the second phase providing a voltage exceeding a threshold of the chiral smectic liquid crystal in combination with the scanning selection signal voltage, the second phase having a period of ΔT, and the first and third phases having a total period of ΔT.

31. An apparatus according to claim 30, wherein said difference is zero.

32. An apparatus according to claim 30, wherein said difference makes a DC component.

33. An apparatus according to claim 30, wherein the first and third phases respectively have a period of ΔT/2.

34. An apparatus according to claim 33, wherein said difference is zero.

35. An apparatus according to claim 33, wherein said difference makes a DC component.

36. An apparatus according to claim 23, wherein only one of said pair of substrates is provided with a uniaxial alignment characteristic and the other substrate is provided with a non-uniaxial alignment characteristic.

37. An apparatus according to claim 36, wherein said non-uniaxial alignment characteristic is a random alignment characteristic.

38. An apparatus according to claim 23, wherein said pair of substrates have alignment control films thereon composed of different film materials and respectively having a uniaxial alignment characteristic.

39. An apparatus according to claim 38, wherein one of the alignment control films comprises an organic film, and the other comprises an inorganic film.

40. An apparatus according to claim 23, wherein said chiral smectic liquid crystal is a liquid crystal developing a ferroelectric state.

41. An apparatus according to claim 23, wherein said chiral smectic liquid crystal is a liquid crystal developing both a ferroelectric state and an anti-ferroelectric state.

42. An apparatus according to claim 23, wherein said chiral smectic liquid crystal comprises at least one liquid crystal component having a fluorinated carbon terminal group including least one completely fluorinated carbon atom.

43. An apparatus according to claim 42, wherein said fluorinated carbon terminal group has 2–15 carbon atoms.

44. An apparatus according to claim 23, wherein said chiral smectic liquid crystal includes a temperature region where smectic A phase is developed from isotropic phase on temperature decease, and said chiral smectic liquid crystal comprises at least one liquid crystal component having a fluorinated carbon terminal group including least one completely fluorinated carbon atom.

45. An apparatus according to claim 44, wherein said fluorinated carbon terminal group has 2–15 carbon atoms.

46. An apparatus according to claim 23, wherein said drive means successively applies the scanning selection signals so that at least two consecutive scanning selection signals are partially overlapped with each other and applied to different scanning electrodes.

47. A liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means including:

means for sequentially applying a scanning selection signal to the scanning electrodes to select at least one scanning electrode, and applying a data signal having at least three phases having mutually different peak values, with reference to a voltage level of a scanning non-selection signal applied to non-selected scanning electrodes, to the data electrodes in synchronism with the scanning selection signal, means for applying a DC voltage uniformly to the data electrodes, and means for switching a polarity of the DC voltage for each vertical scanning period or each horizontal scanning period.

48. An apparatus according to claim 47, wherein said data signal has a maximum voltage $V_0$, and the DC voltage has a value in the range of $0.1V_0$–$5V_0$.

49. An apparatus according to claim 47, wherein said data signal has a maximum voltage $V_0$, and the DC voltage has a value in the range of $0.5V_0$–$3V_0$.

50. An apparatus according to claim 47, wherein the polarity of the DC voltage is switched for each vertical scanning period.

51. An apparatus according to claim 47, wherein the polarity of the DC voltage is switched for each horizontal scanning period.

52. An apparatus according to claim 47, wherein the data signal has a first phase, a second phase and a third phase, the second phase has a period of $\Delta T$, and the first and third phases respectively have a period of $\Delta T/2$.

53. An apparatus according to claim 47, wherein pixels on a scanning electrode not receiving the scanning selection signal are supplied with an AC voltage caused by the data signal, the AC voltage having a time-average value equal to the value of the DC voltage.

54. An apparatus according to claim 47, wherein only one of said pair of substrates is provided with a uniaxial alignment characteristic and the other substrate is provided with a non-uniaxial alignment characteristic.

55. An apparatus according to claim 54, wherein said non-uniaxial alignment characteristic is a random alignment characteristic.

56. An apparatus according to claim 47, wherein said pair of substrates have alignment control films thereon composed of different film materials and respectively having a uniaxial alignment characteristic.

57. An apparatus according to claim 56, wherein one of the alignment control films comprises an organic film, and the other comprises an inorganic film.

58. An apparatus according to claim 47, wherein said chiral smectic liquid crystal is a liquid crystal developing a ferroelectric state.

59. An apparatus according to claim 47, wherein said chiral smectic liquid crystal is a liquid crystal developing both a ferroelectric state and an anti-ferroelectric state.

60. An apparatus according to claim 47, wherein said chiral smectic liquid crystal comprises at least one liquid crystal component having a fluorinated carbon terminal group including least one completely fluorinated carbon atom.

61. An apparatus according to claim 60, wherein said fluorinated carbon terminal group has 2–15 carbon atoms.

62. An apparatus according to claim 47, wherein said chiral smectic liquid crystal includes a temperature region where smectic A phase is developed from isotropic phase on temperature decease, and said chiral smectic liquid crystal comprises at least one liquid crystal component having a fluorinated carbon terminal group including least one completely fluorinated carbon atom.

63. An apparatus according to claim 62, wherein said fluorinated carbon terminal group has 2–15 carbon atoms.

64. A liquid crystal apparatus comprising:

(a) a liquid crystal panel including: a pair of substrates having thereon a group of scanning electrodes and a group of data electrodes, respectively, and provided with mutually different alignment characteristics, and a chiral smectic liquid crystal disposed between the substrates so as to form a pixel at each intersection of the scanning electrodes and the data electrodes, and (b) drive means including:

means for sequentially applying a scanning selection signal to the scanning electrodes to select at least one scanning electrode, said scanning selection signal comprising voltages of at least a first phase and a second phase having mutually different peak values, and applying a data signal having at least three phases having mutually different peak values, with reference to a voltage level of a scanning non-selection signal applied to non-selected scanning electrodes, to the data electrodes in synchronism with the scanning selection signal, so that in the first phase, the pixels on the selected scanning electrode are non-selectively reset to a cleared state and, in the second phase, a selected pixel among the cleared pixels is supplied with a voltage exceeding another threshold of the chiral smectic liquid crystal to be written into a display state;

means for applying a DC voltage uniformly to the data electrodes; and means for switching a polarity of the DC voltage for each vertical scanning period or each horizontal scanning period.

65. An apparatus according to claim 64, wherein said data signal has a voltage waveform including a first phase, a second phase and a third phase having mutually different peak values, and the second phase of the data signal is synchronized with the second phase of the scanning selection signal.

66. An apparatus according to claim 64, wherein said drive means successively applies the scanning selection signals so that at least two consecutive scanning selection signals are partially overlapped with each other and applied to different scanning electrodes.

67. An apparatus according to claim 64, wherein said DC voltage is applied to scanning electrodes not supplied with the scanning selection signal.

68. An apparatus according to claim 64, wherein said DC voltage is applied uniformly to the data electrodes.

69. An apparatus according to claim 64, wherein said data signal has a maximum voltage $V_0$, and the DC voltage has a value in the range of $0.1V_0$–$5V_0$.

70. An apparatus according to claim 64, wherein said data signal has a maximum voltage $V_0$, and the DC voltage has a value in the range of $0.5V_0$–$3V_0$.

71. An apparatus according to claim 64, wherein the polarity of the DC voltage is switched for each vertical scanning period.

72. An apparatus according to claim 64, wherein the polarity of the DC voltage is switched for each horizontal scanning period.

73. An apparatus according to claim 64, wherein the data signal has a first phase, a second phase and a third phase, the second phase has a period of $\Delta T$, and the first and third phases respectively have a period of $\Delta T/2$.

74. An apparatus according to claim 64, wherein pixels on a scanning electrode not receiving the scanning selection signal are supplied with an AC voltage caused by the data signal, the AC voltage having a time-average value equal to the value of the DC voltage.

75. An apparatus according to claim 64, wherein only one of said pair of substrates is provided with a uniaxial alignment characteristic and the other substrate is a non-uniaxial alignment characteristic.

76. An apparatus according to claim 75, wherein said non-uniaxial alignment characteristic is a random alignment characteristic.

77. An apparatus according to claim 64, wherein said pair of substrates have alignment control films thereon composed of different film materials and respectively having a uniaxial alignment characteristic.

78. An apparatus according to claim 77, wherein one of the alignment control films comprises an organic film, and the other comprises an inorganic film.

79. An apparatus according to claim 64, wherein said chiral smectic liquid crystal is a liquid crystal developing a ferroelectric state.

80. An apparatus according to claim 64, wherein said chiral smectic liquid crystal is a liquid crystal developing both a ferroelectric state and an anti-ferroelectric state.

81. An apparatus according to claim 64, wherein said chiral smectic liquid crystal comprises at least one liquid crystal component having a fluorinated carbon terminal group including least one completely fluorinated carbon atom.

82. An apparatus according to claim 81, wherein said fluorinated carbon terminal group has 2–15 carbon atoms.

83. An apparatus according to claim 64, wherein said chiral smectic liquid crystal includes a temperature region where smectic A phase is developed from isotropic phase on temperature decease, and said chiral smectic liquid crystal comprises at least one liquid crystal component having a fluorinated carbon terminal group including least one completely fluorinated carbon atom.

84. An apparatus according to claim 83, wherein said fluorinated carbon terminal group has 2–15 carbon atoms.

* * * * *

UNITED STATES PATENT AND TRADEMARK OFFICE

CERTIFICATE OF CORRECTION

PATENT NO. : 5,933,128
DATED : August 3, 1999
INVENTOR(S) : Masaki Kuriyabashi et al.

It is certified that error appears in the above-identified patent and that said Letters Patent is hereby corrected as shown below:

Column 4,
Line 64, “a” should be deleted;
Line 65, “diagram” should read -- diagrams --.

Column 13,
Line 30, “FIG. 13.” should read -- FIGS. 13A-13D. --;
Line 41, “there” should read -- three --;
Line 64, “to solve” should read -- solves --.

Figures 20A, 20B, 20C, 20D:
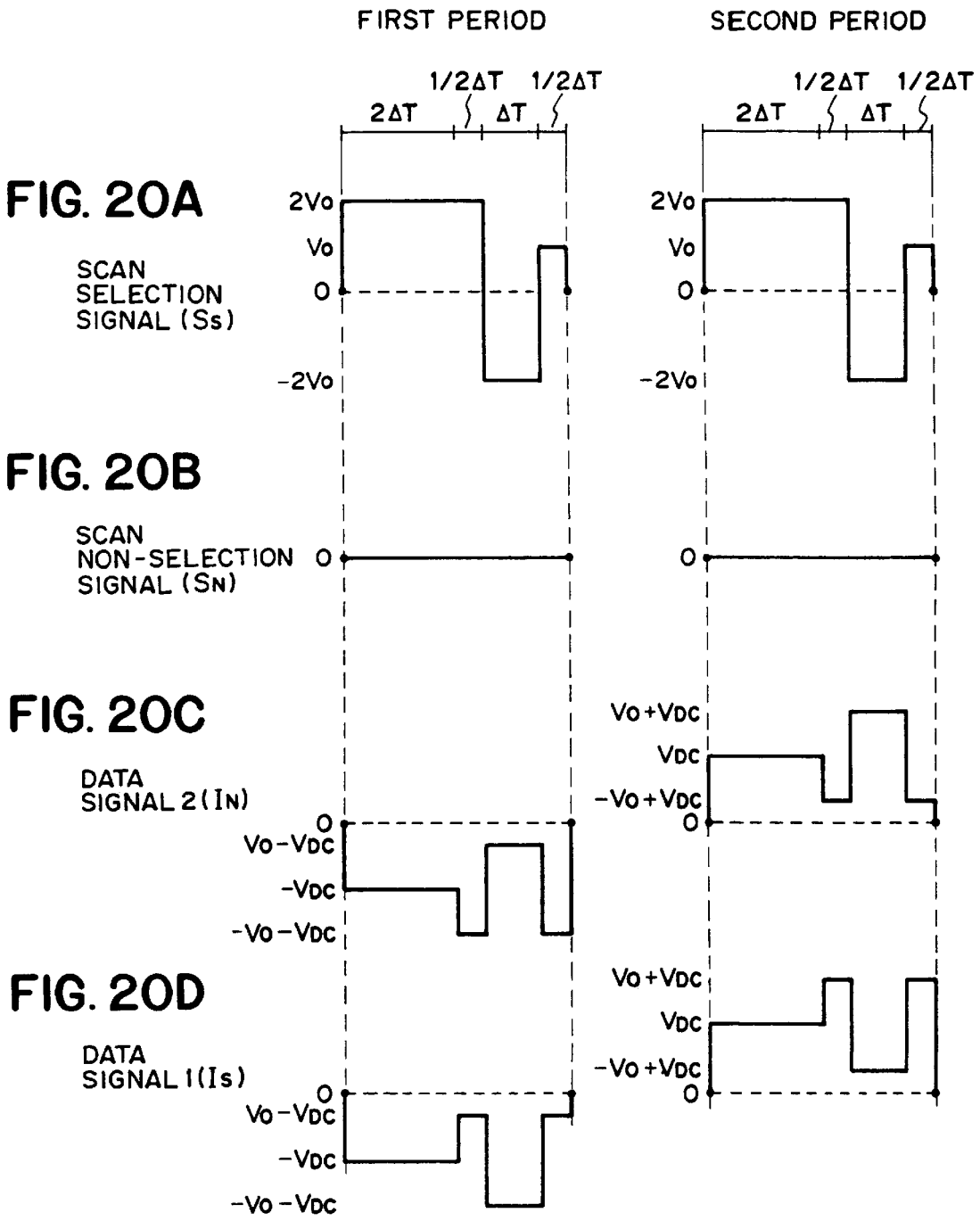
Figures 21A, 21B, 21C, 21D:
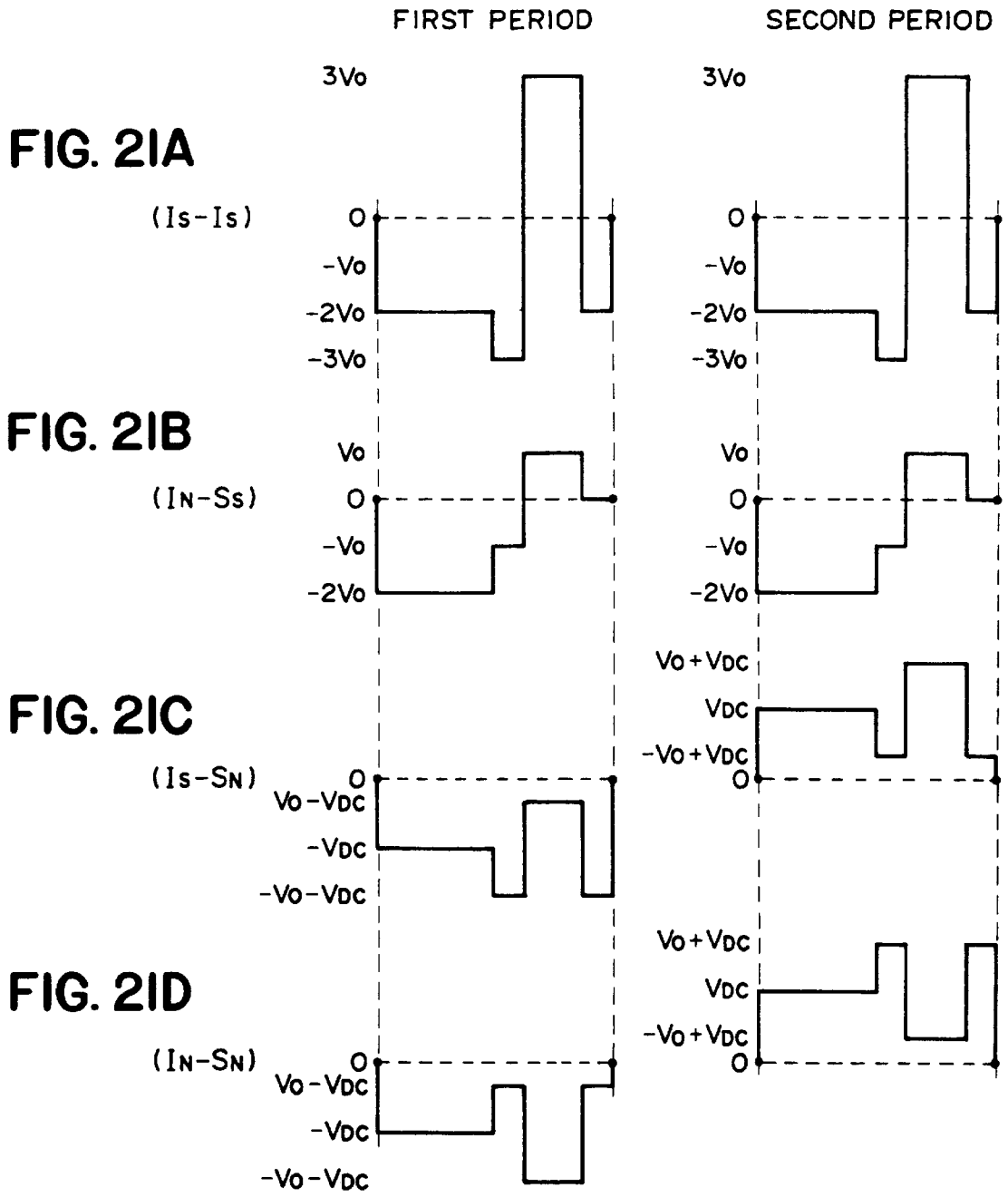
FIGS. 21A–21D constitute a waveform diagram showing a set of drive voltages applied to the pixels based on the signals shown in FIGS. 19A–19D or 20A–20D.
Figures 22A, 22B, 22C, 22D:
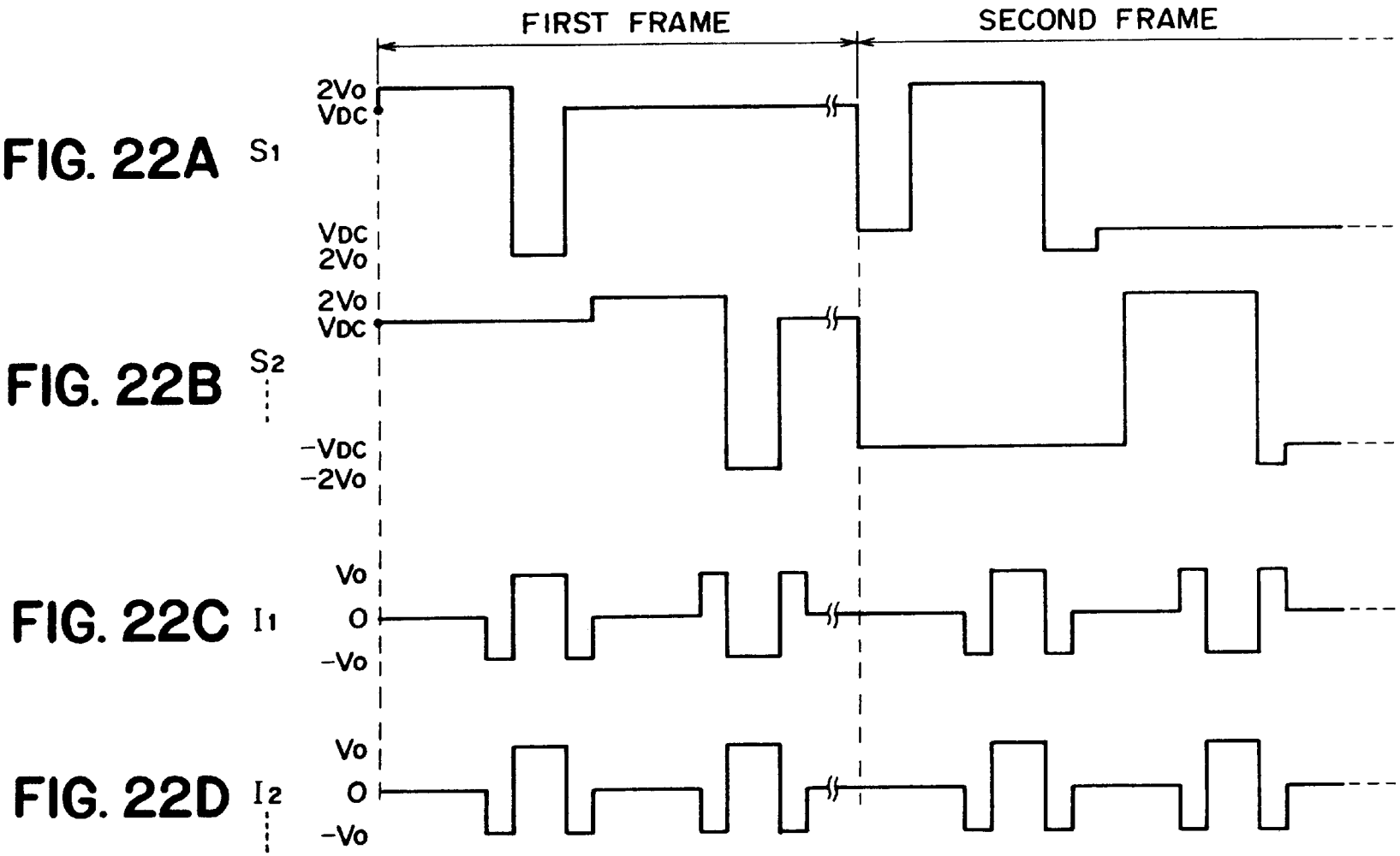
FIGS. 22A–22D and 23A–23D are different time-serial waveforms each obtained by using the drive signals shown in FIGS. 16A–16D.
Figures 23A, 23B, 23C, 23D:
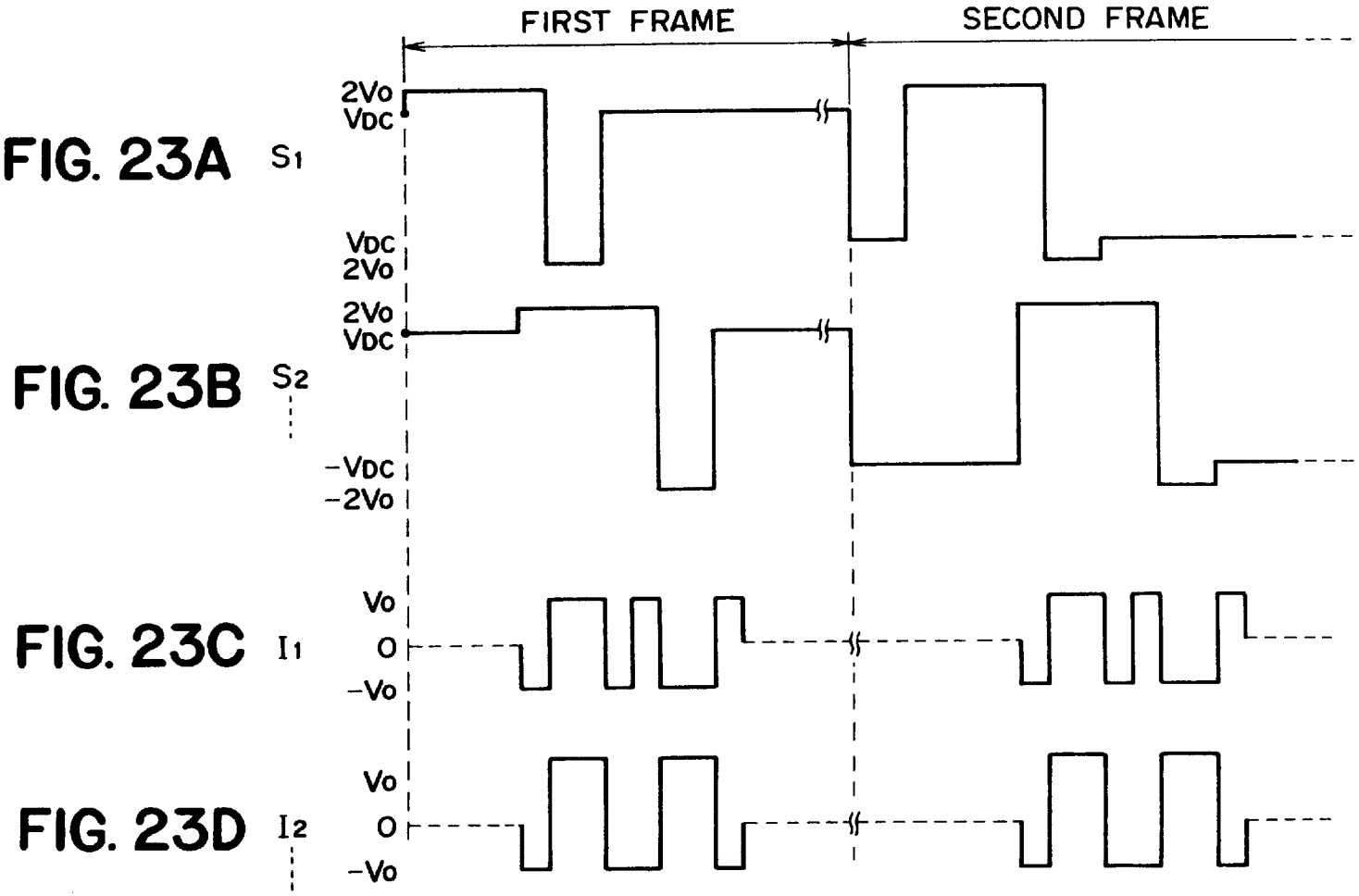
Figures 24A, 24B, 24C, 24D:
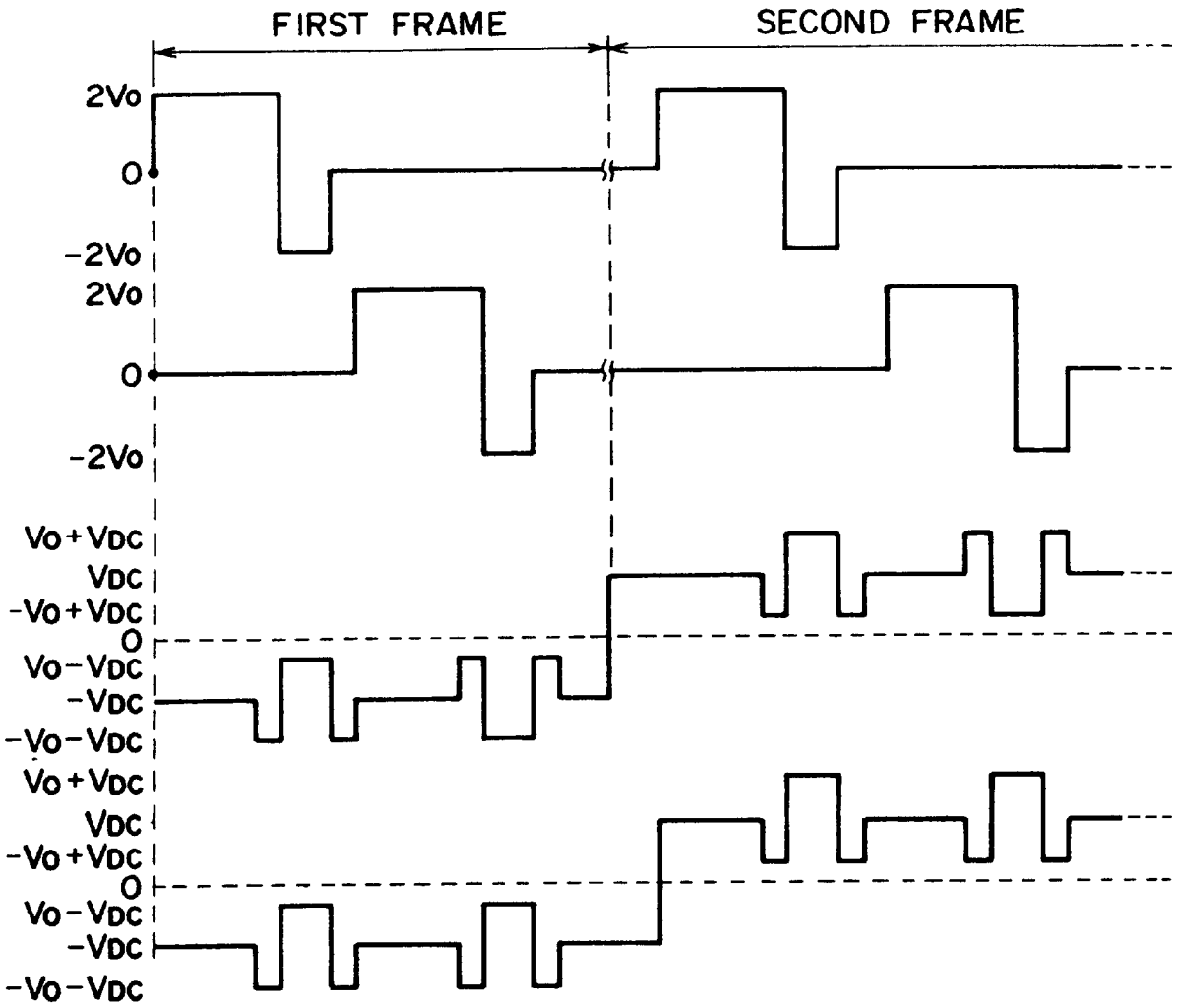
FIGS. 24A–24D and 25A–25D are different time-serial waveforms each obtained by using the drive signals shown in FIGS. 17A–17D.
Figures 25A, 25B, 25C, 25D:
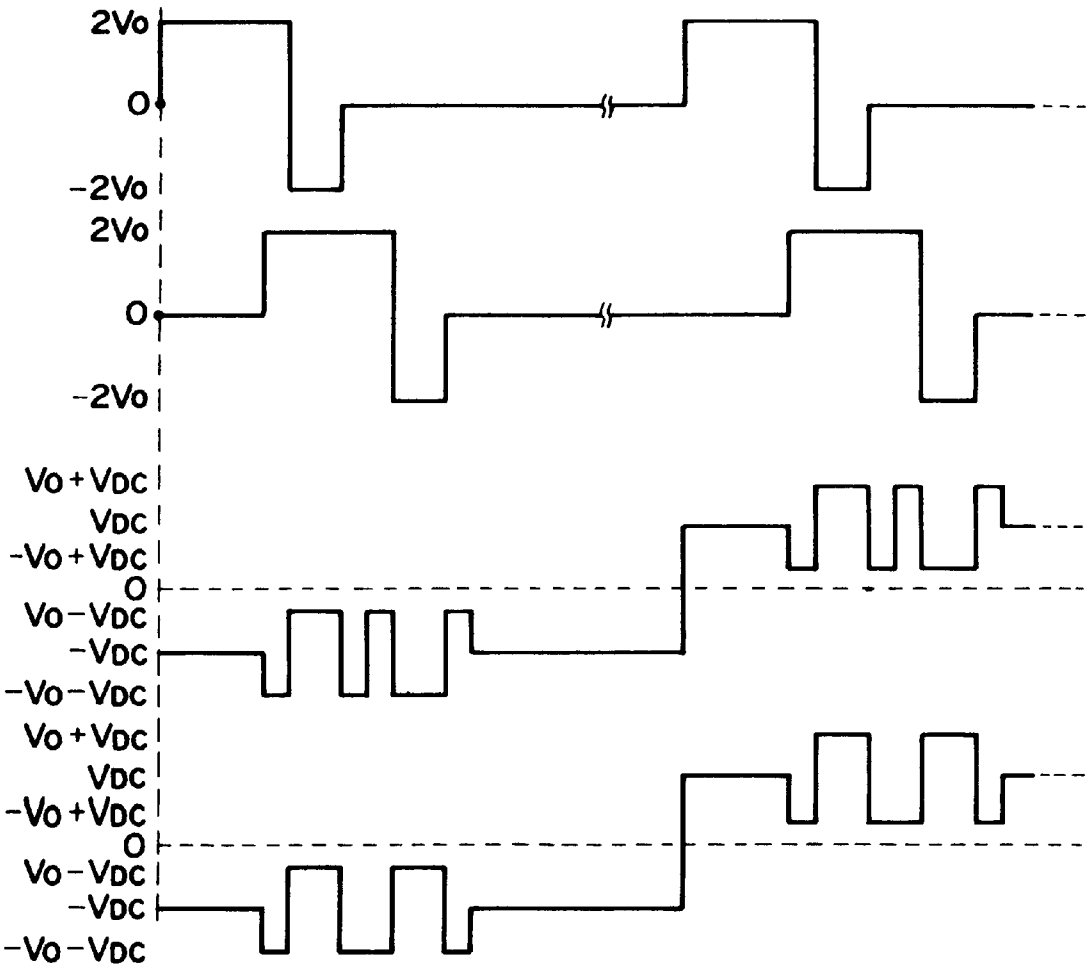

Column 15,
Line 20, “FIG. 20.” should read -- FIGS. 20A-20D --;
Line 42, “FIG. 17” should read -- FIGS. 17A-17D --;
Line 45, “FIG. 25” should read -- FIGS. 25A-25D --.

Column 16,
Line 55, “line;” should read -- line; and --.

Column 17,
Lines 33 and 41, “least” should read -- at least --.

Column 19,
Lines 27 and 36, “least” should read -- at least --.

Column 20,
Lines 43 and 52, “least” should read -- at least --.

Column 22,
Lines 34 and 44, “least” should read -- at least --.

Signed and Sealed this

Twenty-ninth Day of April, 2003

JAMES E. ROGAN
*Director of the United States Patent and Trademark Office*